US008556588B2

(12) United States Patent
Shrum et al.

(10) Patent No.: US 8,556,588 B2
(45) Date of Patent: Oct. 15, 2013

(54) AIRFOIL SHAPE FOR A COMPRESSOR

(75) Inventors: Alexander David Shrum, Anderson, SC (US); Marcus Edward Blohm, Greenville, SC (US)

(73) Assignee: General Electric Company, Schenectady, NY (US)

( * ) Notice: Subject to any disclaimer, the term of this patent is extended or adjusted under 35 U.S.C. 154(b) by 357 days.

(21) Appl. No.: 13/152,660

(22) Filed: Jun. 3, 2011

(65) Prior Publication Data

US 2012/0308395 A1 Dec. 6, 2012

(51) Int. Cl.
*F01D 5/14* (2006.01)

(52) U.S. Cl.
USPC ..... 416/223 A; 416/243

(58) Field of Classification Search
USPC ..... 416/223 A, 243, DIG. 2, DIG. 5
See application file for complete search history.

(56) References Cited

U.S. PATENT DOCUMENTS 6,739,839 B1 5/2004 Brown et al.
6,887,041 B2 5/2005 Coke et al.
6,923,623 B2 8/2005 Cleveland et al.
7,497,665 B2 * 3/2009 King et al. ..... 416/223 A
7,510,378 B2 * 3/2009 LaMaster et al. ..... 416/223 A
7,520,729 B2 4/2009 McGowan et al.
7,524,170 B2 4/2009 Devangada et al.
7,534,092 B2 * 5/2009 Columbus et al. ..... 416/223 R
7,534,093 B2 * 5/2009 Spracher et al. ..... 416/223 A
7,537,434 B2 * 5/2009 Cheruku et al. ..... 416/223 R
7,537,435 B2 * 5/2009 Radhakrishnan et al. 416/223 A
7,540,715 B2 * 6/2009 Latimer et al. ..... 416/223 A
7,572,104 B2 8/2009 Hudson et al.
7,837,445 B2 * 11/2010 Benjamin et al. ..... 416/223 A
2008/0282541 A1 11/2008 Anderson et al.
2009/0097982 A1 4/2009 Saindon et al.
2009/0116967 A1 5/2009 Sleiman et al.
2010/0008784 A1 1/2010 Shafique et al.
2010/0061862 A1 3/2010 Bonini et al.
2010/0092283 A1 4/2010 Hudson et al.
2010/0092284 A1 4/2010 Bonini et al.
2010/0092298 A1 4/2010 Hudson et al.

* cited by examiner

*Primary Examiner* — Dwayne J White
(74) *Attorney, Agent, or Firm* — Dority & Manning, P.A.

(57) ABSTRACT

An article of manufacture is disclosed. The article may have a nominal profile generally in accordance with Cartesian coordinate values of X, Y and Z set forth in TABLE A. X and Y may correspond to distances in inches which, when connected by smooth continuing arcs, define airfoil profile sections at each distance Z in inches, the airfoil profile sections at the Z distances being joined smoothly with one another to form a complete airfoil shape.

12 Claims, 5 Drawing Sheets

FIG. —1—

AIRFOIL SHAPE FOR A COMPRESSOR

FIELD OF THE INVENTION

The present subject matter relates generally to the design of airfoils. In particular, the present subject matter relates to compressor airfoil profiles for various stages of a gas turbine compressor, such as for use as rotor blades and stator vanes at various stages of the compressor. More particularly, the present subject matter relates to compressor airfoil profiles for a "Stage Zero" rotor blade.

BACKGROUND OF THE INVENTION

In a gas turbine, many system requirements should be met at each stage of a gas turbine's flow path section to meet design goals. These design goals may include, but are not limited to, overall improved efficiency, airfoil loading capability and component reliability. For example, a rotor blade of a compressor rotor may be designed to achieve thermal and mechanical operating requirements for the particular compressor stage at which it is located. Similarly, for example, a stator vane of a compressor stator may be designed to achieve thermal and mechanical operating requirements for the particular stage at which it is located.

Accordingly, an airfoil profile configured to meet the above mentioned design goals would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter discloses an article of manufacture. The article may have a nominal profile generally in accordance with Cartesian coordinate values of X, Y and Z set forth in TABLE A. X and Y may correspond to distances in inches which, when connected by smooth continuing arcs, define airfoil profile sections at each distance Z in inches, the airfoil profile sections at the Z distances being joined smoothly with one another to form a complete airfoil shape.

In another aspect, the present subject matter discloses a rotor blade having an airfoil. The airfoil may have a nominal profile generally in accordance with Cartesian coordinate values of X, Y and Z set forth in TABLE A. X and Y may correspond to distances in inches which, when connected by smooth continuing arcs, define airfoil profile sections at each distance Z in inches, the airfoil profile sections at the Z distances being joined smoothly with one another to form a complete airfoil shape.

In a further aspect, the present subject matter discloses a compressor having a rotor wheel and a plurality of rotor blades mounted to the rotor wheel. Each rotor blade includes an airfoil. The airfoil may have a nominal profile generally in accordance with Cartesian coordinate values of X, Y and Z set forth in TABLE A. X and Y may be distances in inches which, when connected by smooth continuing arcs, define airfoil profile sections at each distance Z in inches, the airfoil profile sections at the Z distances being joined smoothly with one another to form a complete airfoil shape.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
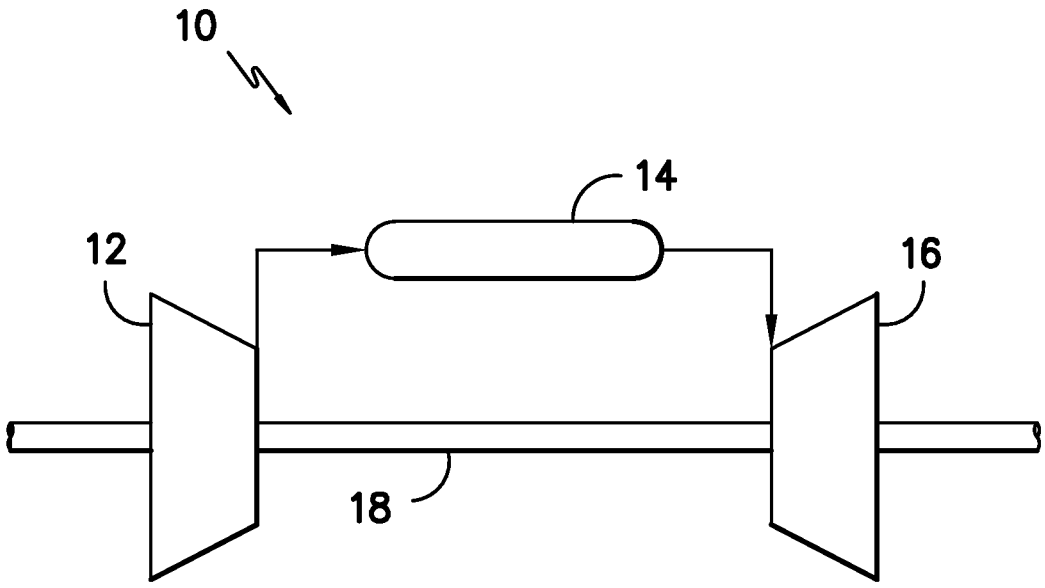
FIG. 1 illustrates a schematic depiction of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter discloses an article of manufacture having a nominal profile generally in accordance with the Cartesian coordinate values of X, Y and Z set forth in TABLE A below. In several embodiments, the article of manufacture may comprise an airfoil suitable for use within one of the stages of a gas turbine compressor. In such embodiments, the X and Y values may generally correspond to distances (measured in inches) which, when connected by smooth continuing arcs, define airfoil profile sections at each distance Z (measured in inches), with the airfoil profile sections at the Z distances being joined smoothly with one another to form a complete airfoil shape. Thus, in one embodiment, the X, Y and Z coordinate values may define a nominal airfoil profile for a rotor blade of the gas turbine compressor. For example, the airfoil profile disclosed herein may be used to form rotor blades comprising the first rotating stage ("Stage Zero" or "R0") of the compressor. Alternatively, the X, Y and Z coordinate values may define a nominal airfoil profile for a stator vane of the gas turbine compressor.

The nominal airfoil profile defined by the coordinate values in TABLE A may generally provide numerous advantages as compared to other similar airfoil profiles having like applications. In particular, the inventors of the present subject matter have found that the disclosed airfoil profile may enhance rotor and/or stator stage airflow efficiency, improve aeromechanics, enhance the interaction between compressor stages to provide a smooth laminar flow from stage to stage, reduce thermal and mechanical stresses acting on the airfoil and enhance root airfoil root and tip stability, as well as provide numerous other advantages to the overall performance of a compressor and/or a gas turbine.

Moreover, it should be appreciated that an airfoil heats up during use. Thus, the airfoil profile will change as a result of mechanical loading and temperature. Accordingly, the cold or room temperature profile, for manufacturing purposes, is given by the X, Y and Z coordinates of TABLE A. A distance of plus or minus about 0.160 inches (+/−0.160") from the nominal profile in a direction normal to any surface location along the nominal profile and which includes any coating, defines a profile envelope for the airfoil, as a manufactured airfoil profile may be different from the nominal airfoil profile provided in TABLE A.

Referring now to the drawings, FIG. 1 illustrates a schematic depiction of a gas turbine 10. The gas turbine 10 includes a compressor 12, a combustion section 14 having a plurality of combustors, and a turbine section 16. The compressor 12 and turbine section 16 may be coupled by a drive shaft 18. The drive shaft 18 may be a single shaft or a plurality of shaft segments coupled together to form the drive shaft 18. During operation of the gas turbine 10, the compressor 12 supplies compressed air to the combustion section 14. The compressed air is mixed with fuel and burned within each combustor and hot gases of combustion flow from the combustion section 14 to the turbine section 16, wherein energy is extracted from the hot gases to produce work.

Figure 2:
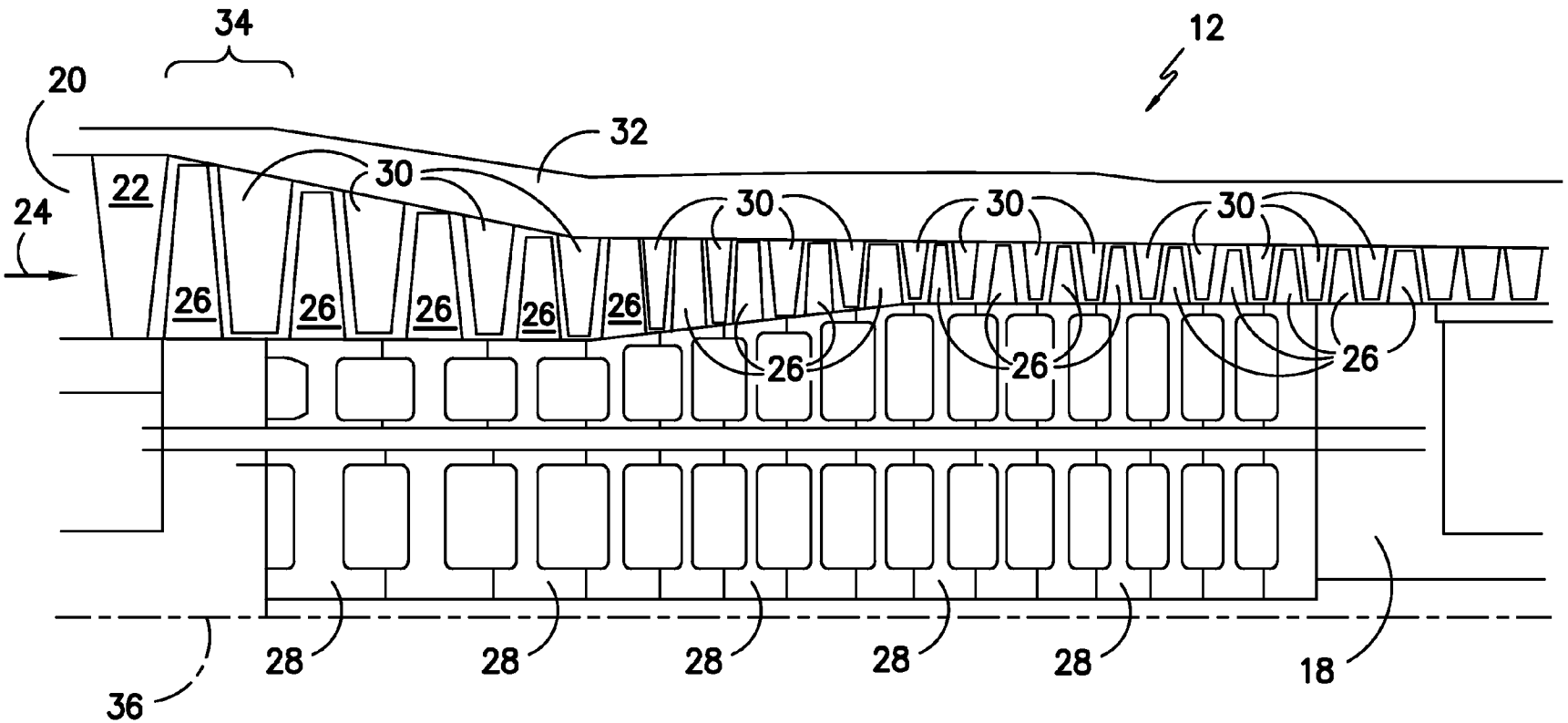
FIG. 2 illustrates a cross-sectional view of one embodiment of a flow path through multiple stages of a gas turbine compressor.
Figure 5:
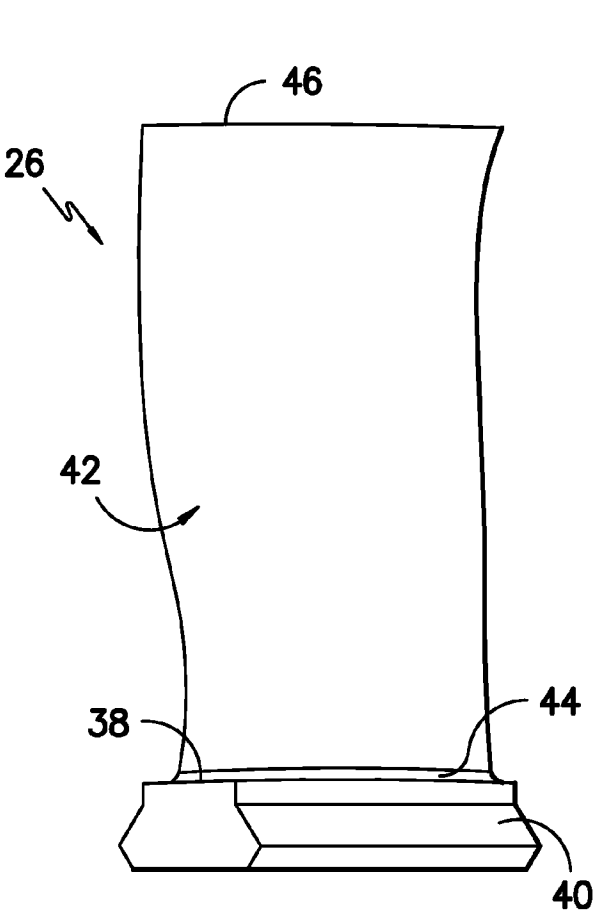
FIGS. 5 and 6 illustrate side elevational views of the rotor blade shown in FIG. 3 as viewed in a generally circumferential direction from the pressure and suction sides of the blade airfoil, respectively.
Figure 4:
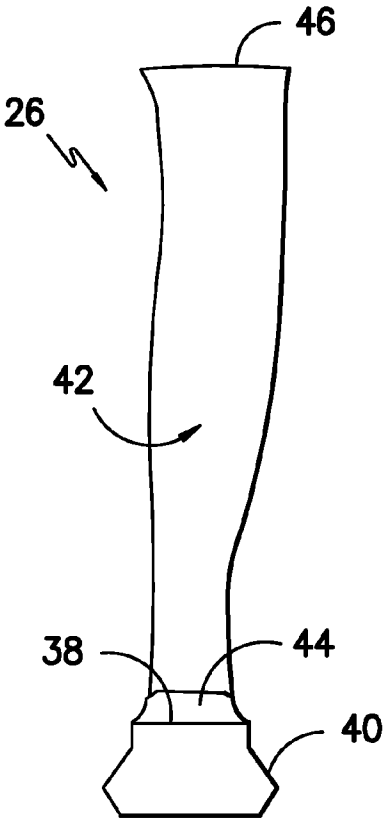
FIGS. 3 and 4 illustrate respective perspective views of one embodiment of a compressor rotor blade in accordance with aspects of the present subject matter, particularly illustrating the blade airfoil together with its corresponding platform and dovetail root.
Figure 3:
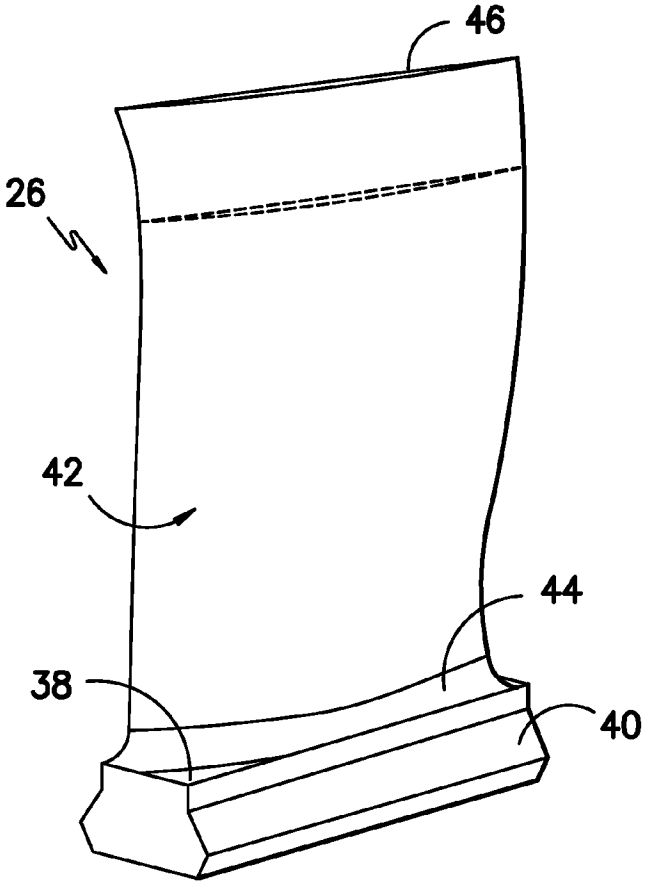

Referring now to FIG. 2, one embodiment of an axial flow path 20 of a gas turbine compressor 12 is illustrated. As shown, the compressor 12 generally includes an inlet guide vane 22 disposed at the inlet of the compressor 12 and a plurality of compressor stages disposed downstream of the inlet guide vane 22 along the axial flow path 20 (the direction of the airflow within the flow path 20 being indicated by the arrow 24). Each compressor stage may generally include a rotor stage having a plurality of rotor blades 26 mounted onto a rotor wheel 28 of the compressor 12 and a stator stage following each rotor stage having a plurality of stator vanes 30 attached to a static casing 32 of the compressor 12. For example, the initial compressor stage 34 disposed within the flow path 20 of the compressor 12 may correspond to "Stage Zero" of the compressor 12, with subsequent compressor stages being sequentially numbered in the downstream direction of the compressor 12 (e.g., "Stage One," "Stage Two," etc.). As such, the rotor blades 26 disposed within the initial compressor stage 34 may correspond to "Stage Zero" or "R0" rotor blades 26 and the stator vanes 30 disposed within the initial compressor stage 34 may correspond to "Stage Zero" or "S0" stator vanes 30.

In general, the alternating rows of rotor blades 26 and stator vanes 30 may be designed to bring about a desired pressure rise in the air flowing through the compressor 12. For example, the rotor blades 26 may be configured to impart kinetic energy to the airflow and the stator vanes 30 may be configured to convert the increased rotational kinetic energy within the airflow into increased static pressure through diffusion. Thus, it should be appreciated that the particular configuration of the airfoil included in each rotor blade 26 and/or stator vane 30 (along with its interaction with the surrounding airfoils of adjacent rotor blades 26 and/or stator vanes 30) may generally provide for stage airflow efficiency, enhanced aeromechanics, smooth laminar flow from stage to stage, reduced thermal stresses, enhanced interrelation of the stages to effectively pass the airflow from stage to stage, and reduced mechanical stresses.

As indicated above, each rotor stage may generally include a plurality of circumferentially spaced rotor blades 26 mounted onto one of the rotor wheels 28 about a centerline 36 of the compressor 12. The rotor wheels 28 may, in turn, be attached to the drive shaft 18 of the gas turbine 10 (FIG. 1) for rotation therewith. The drive shaft 18 may then be coupled to the turbine section 16 of the gas turbine 10 (FIG. 1) such that the energy extracted within the turbine section 16 may be used to drive the compressor 12.

Figure 7:
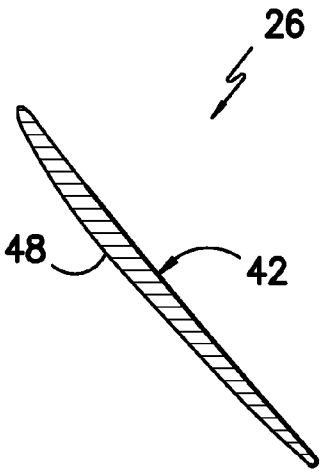
FIG. 7 illustrates a cross-sectional view of the blade airfoil taken generally about line 7-7 of FIG. 6.

Referring now to FIGS. 3-8, each rotor blade 26 of the compressor 12 may generally include a platform 38, a root 40 extending radially inwardly from the platform 38 and an airfoil 42 extending radially outwardly from the platform 38. The root 40 may generally be configured to provide a means for attaching each rotor blade 26 to one of the rotor wheels 28. For example, the root 40 may be configured as a substantially or near axial entry dovetail for connection with a complementary-shaped mating dovetail (not shown) of the rotor wheel 28. The airfoil 42 of each rotor blade 26 may generally extend radially between an airfoil base 44 disposed at the platform 38 and an airfoil tip 46 disposed opposite the airfoil base 44. Additionally, the airfoil 42 may generally define an aerodynamic shape. For instance, as shown in FIG. 7, the airfoil 42 of each of rotor blade 26 may generally have a profile section 48 at any cross-section from the airfoil base 44 to the airfoil tip 46.

Figure 9:
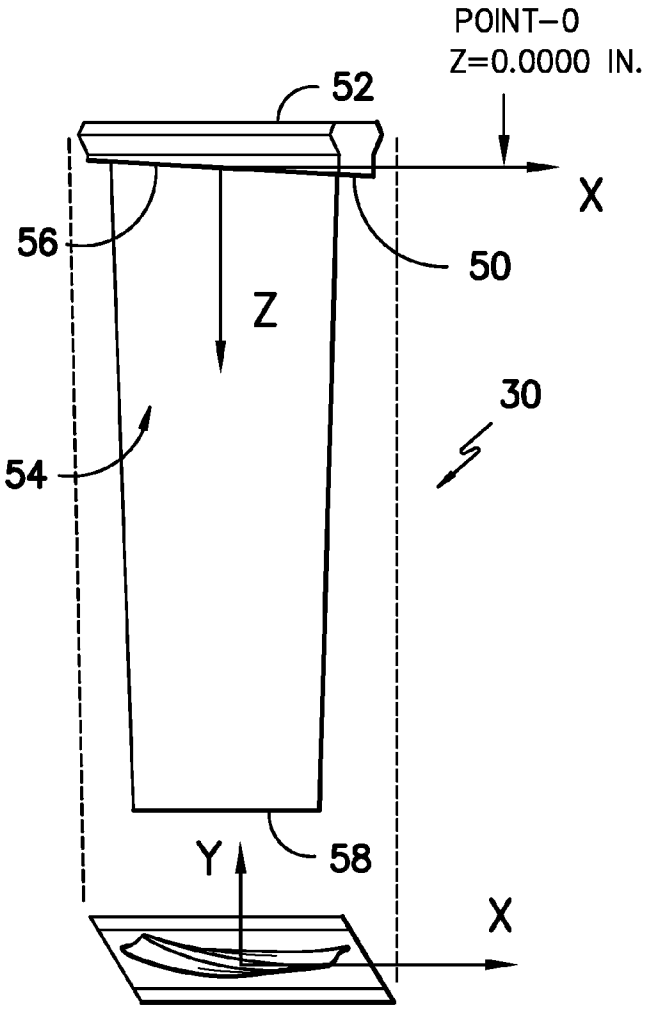
FIG. 9 illustrates differing views of one embodiment of a compressor stator vane in accordance with aspects of the present subject matter, particularly illustrating the stator vane with the X, Y and Z axes of the Cartesian Coordinate System superimposed thereon.

Referring now to FIG. 9, similar to the rotor blades 26, each stator vane 30 of the compressor 12 may generally include a platform 50, a root 52 extending radially outwardly from the platform 50 and an airfoil 54 extending radially inwardly from the platform 50. The root 52 may generally be configured to provide a means for attaching each stator vane 30 to a portion of the static casing 32 of the compressor 12. Additionally, the airfoil 54 of each stator vane 30 may generally extend radially between an airfoil base 56 disposed at the platform 50 and an airfoil tip 58 disposed opposite the airfoil base 56. The airfoil 54 may also define an aerodynamic shape and, thus, may have a profile section the same as or similar to the profile section 48 shown in FIG. 7.

To define the airfoil profile of a rotor blade 26 and/or stator vane 30 of a compressor 12, a unique set or loci of points (identified by the X, Y and Z Cartesian Coordinates of TABLE A below) are provided to achieve the necessary efficiency, operability, durability and cost requirements for improved compressor performance. In particular, this unique loci of points has been developed through source codes, iterative modeling and/or other design practices such that the airfoil profile defined by the points generally meets the stage requirements for a "Stage Zero" or "R0" rotor blade 26 such that R0 rotor blades 26 may be manufactured and meet the desired requirements for stage efficiency and reduced thermal and mechanical stresses.

It should be appreciated that the Cartesian coordinate system of X, Y and Z values provided in TABLE A define an airfoil profile at various locations along the airfoil's length. The coordinate values for the X, Y and Z coordinates are set forth in inches, although other units of dimensions may be used when the values are appropriately converted. These values exclude fillet regions of the platform. Additionally, the X, Y, and Z coordinates may be joined smoothly at each Z location to form a smooth continuous airfoil cross-section. Moreover, each defined airfoil section in the X, Y plane is joined smoothly with adjacent airfoil sections in the Z direction to form the complete airfoil shape.

Figure 6:
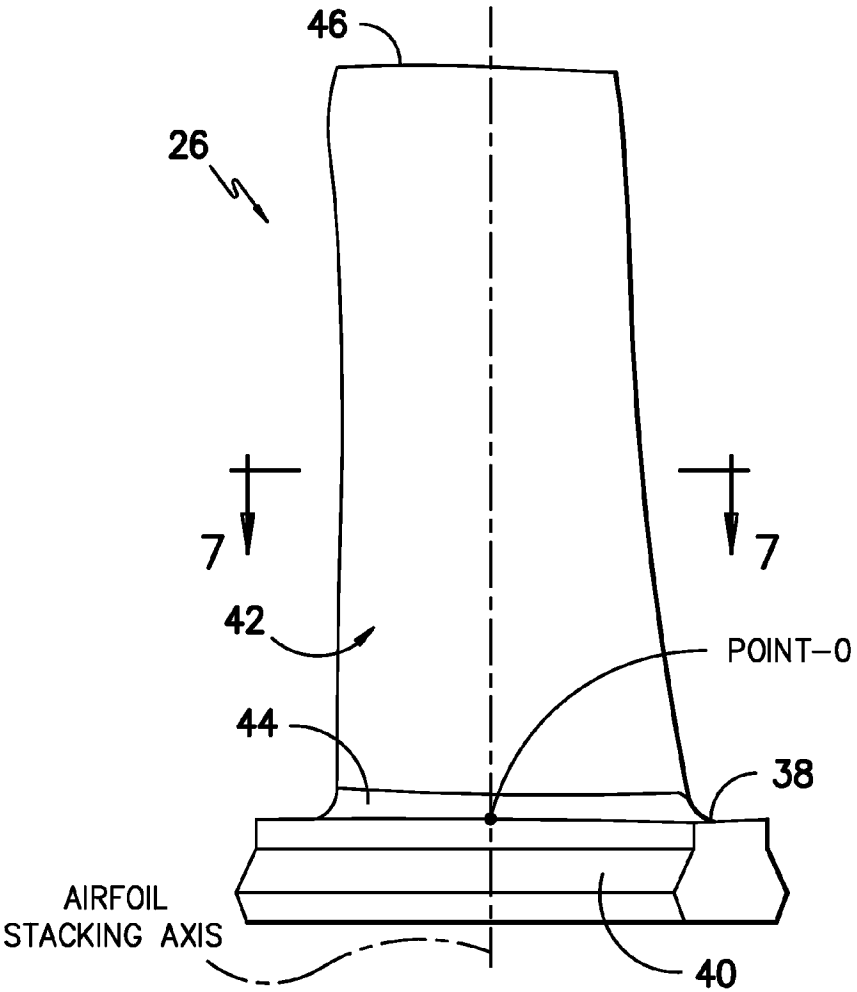
Figure 8:
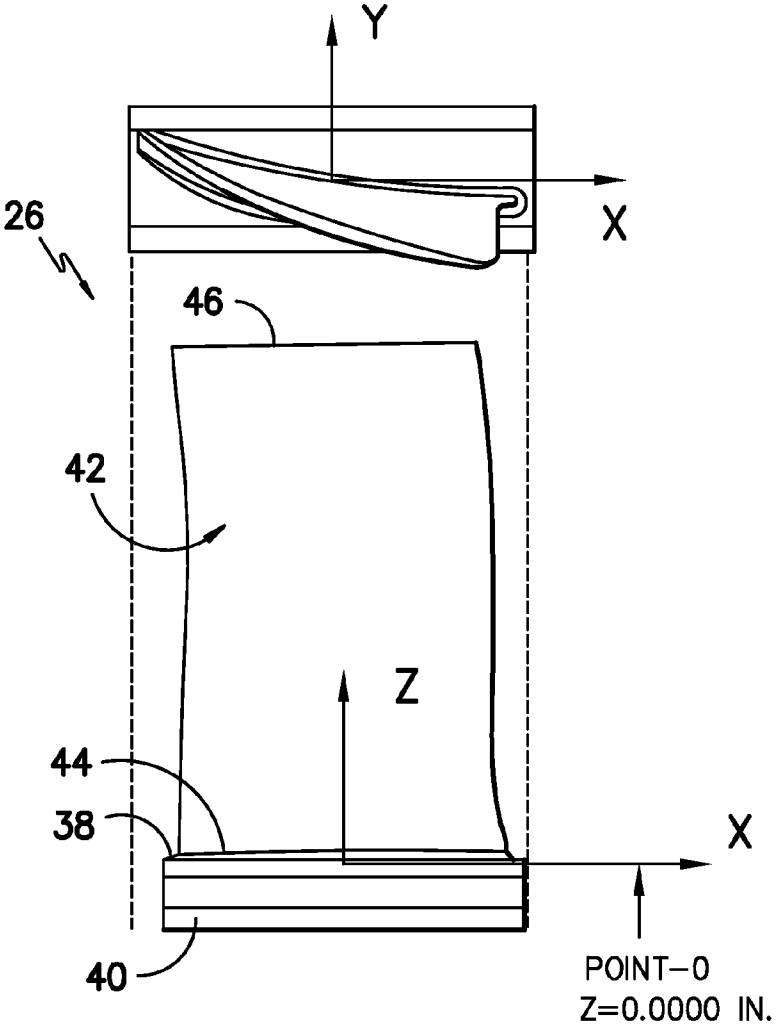
FIG. 8 illustrates differing views of the rotor blade shown in FIG. 3, particularly illustrating the rotor blade with the X, Y and Z axes of the Cartesian Coordinate System superimposed thereon.

Additionally, the Cartesian coordinate system used herein has orthogonally-related X, Y and Z axes. For reference purposes only, there is established a Point-0 passing through the intersection of the airfoil and the platform along the stacking axis of the disclosed airfoil profile, as illustrated in FIG. 6. Thus, in the embodiments disclosed herein, the Point-0 may be defined as the reference profile section where the Z coordinate of TABLE A is at 0.000 inches, which may be set a predetermined distance from the compressor centerline 36. Additionally, as shown in FIGS. 8 and 9, the X axis may be defined parallel to the dovetail axis of the rotor blade 26 and/or the stator vane 30, which may be parallel or at an angle to the compressor centerline 36. A positive X coordinate value may, for example, be axial toward the aft, exhaust end of the compressor 12. A positive Y coordinate value may be directed normal to the dovetail axis. A positive Z coordinate value may be directed radially toward the tip 46, 58 of the airfoil 42, 54, which may be radially outward towards the static casing 32 of the compressor 12 for rotor blades 26 and radially inward towards the centerline 36 of the compressor 12 for stator vanes 30.

By defining X and Y coordinate values at selected locations in a Z direction normal to the X, Y plane, the profile section of the airfoil, such as, but not limited to, the profile section 48 shown in FIG. 7, at each Z distance along the length of the airfoil can be ascertained. By connecting the X and Y values with smooth continuing arcs, each profile section 48 at each distance Z can be fixed. The airfoil profiles of the various surface locations between the distances Z are determined by smoothly connecting the adjacent profile sections 48 to one another, thus forming the airfoil profile. It should be appreciated that, as indicated above, the values provided in TABLE A represent the airfoil profiles at ambient, non-operating or non-hot conditions and are for an uncoated airfoil.

The TABLE A coordinate values have been generated and are shown to three decimal places for determining the profile of the airfoil. There are typical manufacturing tolerances as well as coatings which should be accounted for in the actual profile of the airfoil. Accordingly, the values for the profile given are for a nominal airfoil. It will therefore be appreciated that +/− typical manufacturing tolerances, such as +/− values including coating thicknesses, are additive to the X and Y values. Therefore, a distance of about +/−0.160" in a direction normal to any surface location along the airfoil profile defines an airfoil profile envelope for the disclosed airfoil design. In other words, a distance of about +/−0.160" in a direction normal to any surface location along the airfoil profile defines a range of variation between measured points on the actual airfoil surface at nominal cold or room temperature and the ideal position of those points, at the same temperature, as embodied by the invention.

The coordinate values given in TABLE A below provide the nominal profile envelope for an exemplary embodiment of a "Stage Zero" or "R0" rotor blade 26. However, as indicated above, it should be appreciated that, in alternative embodiments, the disclosed coordinate values may be utilized to manufacture airfoil profiles for rotor blades 26 of differing compressor stages and/or stator vanes 30 for any of the various stages of the compressor 12.

TABLE A

| X | Y | Z |
|---|---|---|
| −3.5642 | 0.5154 | −0.4000 |
| −3.5636 | 0.5167 | −0.4000 |
| −3.5624 | 0.5193 | −0.4000 |
| −3.5599 | 0.5244 | −0.4000 |
| −3.5540 | 0.5341 | −0.4000 |
| −3.5430 | 0.5480 | −0.4000 |
| −3.5187 | 0.5686 | −0.4000 |
| −3.4807 | 0.5877 | −0.4000 |
| −3.4255 | 0.5997 | −0.4000 |
| −3.3551 | 0.5989 | −0.4000 |
| −3.2642 | 0.5842 | −0.4000 |
| −3.1598 | 0.5645 | −0.4000 |
| −3.0482 | 0.5446 | −0.4000 |
| −2.9224 | 0.5236 | −0.4000 |
| −2.7825 | 0.5013 | −0.4000 |
| −2.6283 | 0.4793 | −0.4000 |
| −2.4669 | 0.4579 | −0.4000 |
| −2.2982 | 0.4381 | −0.4000 |
| −2.1220 | 0.4210 | −0.4000 |
| −1.9385 | 0.4064 | −0.4000 |
| −1.7476 | 0.3951 | −0.4000 |
| −1.5494 | 0.3875 | −0.4000 |
| −1.3442 | 0.3837 | −0.4000 |
| −1.1319 | 0.3843 | −0.4000 |
| −0.9195 | 0.3883 | −0.4000 |
| −0.7071 | 0.3944 | −0.4000 |
| −0.4947 | 0.4023 | −0.4000 |
| −0.2825 | 0.4117 | −0.4000 |
| −0.0703 | 0.4234 | −0.4000 |
| 0.1416 | 0.4377 | −0.4000 |
| 0.3535 | 0.4529 | −0.4000 |
| 0.5654 | 0.4688 | −0.4000 |
| 0.7772 | 0.4849 | −0.4000 |
| 0.9891 | 0.5001 | −0.4000 |
| 1.2010 | 0.5153 | −0.4000 |
| 1.4058 | 0.5308 | −0.4000 |
| 1.6035 | 0.5458 | −0.4000 |
| 1.7943 | 0.5584 | −0.4000 |
| 1.9781 | 0.5696 | −0.4000 |
| 2.1546 | 0.5825 | −0.4000 |
| 2.3241 | 0.5960 | −0.4000 |
| 2.4865 | 0.6075 | −0.4000 |
| 2.6349 | 0.6178 | −0.4000 |
| 2.7692 | 0.6270 | −0.4000 |
| 2.8894 | 0.6324 | −0.4000 |
| 2.9955 | 0.6366 | −0.4000 |
| 3.0874 | 0.6418 | −0.4000 |
| 3.1652 | 0.6471 | −0.4000 |
| 3.2315 | 0.6504 | −0.4000 |
| 3.2853 | 0.6384 | −0.4000 |
| 3.3245 | 0.6160 | −0.4000 |
| 3.3509 | 0.5912 | −0.4000 |
| 3.3674 | 0.5689 | −0.4000 |
| 3.3775 | 0.5505 | −0.4000 |
| 3.3842 | 0.5346 | −0.4000 |
| 3.3886 | 0.5214 | −0.4000 |
| 3.3912 | 0.5112 | −0.4000 |
| 3.3934 | 0.5000 | −0.4000 |
| 3.3953 | 0.4849 | −0.4000 |
| 3.3960 | 0.4660 | −0.4000 |
| 3.3944 | 0.4431 | −0.4000 |
| 3.3879 | 0.4135 | −0.4000 |
| 3.3723 | 0.3771 | −0.4000 |
| 3.3423 | 0.3381 | −0.4000 |
| 3.2931 | 0.3047 | −0.4000 |
| 3.2275 | 0.2760 | −0.4000 |
| 3.1503 | 0.2434 | −0.4000 |
| 3.0594 | 0.2039 | −0.4000 |
| 2.9551 | 0.1570 | −0.4000 |
| 2.8358 | 0.1066 | −0.4000 |
| 2.7013 | 0.0531 | −0.4000 |
| 2.5523 | −0.0054 | −0.4000 |
| 2.3882 | −0.0669 | −0.4000 |
| 2.2162 | −0.1288 | −0.4000 |
| 2.0372 | −0.1937 | −0.4000 |
| 1.8504 | −0.2596 | −0.4000 |
| 1.6546 | −0.3228 | −0.4000 |
| 1.4503 | −0.3839 | −0.4000 |

TABLE A-continued

| X | Y | Z |
|---|---|---|
| 1.2375 | −0.4431 | −0.4000 |
| 1.0162 | −0.4996 | −0.4000 |
| 0.7931 | −0.5495 | −0.4000 |
| 0.5686 | −0.5926 | −0.4000 |
| 0.3433 | −0.6293 | −0.4000 |
| 0.1168 | −0.6584 | −0.4000 |
| −0.1109 | −0.6798 | −0.4000 |
| −0.3385 | −0.6929 | −0.4000 |
| −0.5652 | −0.6954 | −0.4000 |
| −0.7909 | −0.6864 | −0.4000 |
| −1.0155 | −0.6655 | −0.4000 |
| −1.2391 | −0.6323 | −0.4000 |
| −1.4617 | −0.5871 | −0.4000 |
| −1.6759 | −0.5326 | −0.4000 |
| −1.8802 | −0.4703 | −0.4000 |
| −2.0743 | −0.4019 | −0.4000 |
| −2.2588 | −0.3291 | −0.4000 |
| −2.4344 | −0.2542 | −0.4000 |
| −2.6007 | −0.1775 | −0.4000 |
| −2.7581 | −0.0996 | −0.4000 |
| −2.9075 | −0.0228 | −0.4000 |
| −3.0417 | 0.0500 | −0.4000 |
| −3.1615 | 0.1175 | −0.4000 |
| −3.2669 | 0.1793 | −0.4000 |
| −3.3631 | 0.2415 | −0.4000 |
| −3.4420 | 0.3016 | −0.4000 |
| −3.4974 | 0.3538 | −0.4000 |
| −3.5360 | 0.4012 | −0.4000 |
| −3.5585 | 0.4411 | −0.4000 |
| −3.5684 | 0.4739 | −0.4000 |
| −3.5694 | 0.4930 | −0.4000 |
| −3.5676 | 0.5052 | −0.4000 |
| −3.5659 | 0.5111 | −0.4000 |
| −3.5648 | 0.5140 | −0.4000 |
| −3.5191 | 0.5682 | 0.0000 |
| −3.5185 | 0.5695 | 0.0000 |
| −3.5173 | 0.5721 | 0.0000 |
| −3.5148 | 0.5771 | 0.0000 |
| −3.5090 | 0.5867 | 0.0000 |
| −3.4979 | 0.6003 | 0.0000 |
| −3.4734 | 0.6203 | 0.0000 |
| −3.4352 | 0.6380 | 0.0000 |
| −3.3801 | 0.6482 | 0.0000 |
| −3.3103 | 0.6454 | 0.0000 |
| −3.2204 | 0.6300 | 0.0000 |
| −3.1168 | 0.6109 | 0.0000 |
| −3.0061 | 0.5914 | 0.0000 |
| −2.8815 | 0.5703 | 0.0000 |
| −2.7429 | 0.5477 | 0.0000 |
| −2.5902 | 0.5246 | 0.0000 |
| −2.4303 | 0.5017 | 0.0000 |
| −2.2633 | 0.4796 | 0.0000 |
| −2.0890 | 0.4590 | 0.0000 |
| −1.9074 | 0.4402 | 0.0000 |
| −1.7186 | 0.4237 | 0.0000 |
| −1.5226 | 0.4101 | 0.0000 |
| −1.3194 | 0.3997 | 0.0000 |
| −1.1089 | 0.3931 | 0.0000 |
| −0.8982 | 0.3901 | 0.0000 |
| −0.6876 | 0.3898 | 0.0000 |
| −0.4769 | 0.3916 | 0.0000 |
| −0.2662 | 0.3947 | 0.0000 |
| −0.0556 | 0.3997 | 0.0000 |
| 0.1549 | 0.4074 | 0.0000 |
| 0.3654 | 0.4165 | 0.0000 |
| 0.5758 | 0.4264 | 0.0000 |
| 0.7863 | 0.4364 | 0.0000 |
| 0.9967 | 0.4457 | 0.0000 |
| 1.2072 | 0.4551 | 0.0000 |
| 1.4107 | 0.4644 | 0.0000 |
| 1.6071 | 0.4731 | 0.0000 |
| 1.7966 | 0.4804 | 0.0000 |
| 1.9790 | 0.4870 | 0.0000 |
| 2.1545 | 0.4945 | 0.0000 |
| 2.3228 | 0.5025 | 0.0000 |
| 2.4842 | 0.5094 | 0.0000 |
| 2.6315 | 0.5153 | 0.0000 |
| 2.7649 | 0.5203 | 0.0000 |

TABLE A-continued

| X | Y | Z |
|---|---|---|
| 2.8842 | 0.5231 | 0.0000 |
| 2.9895 | 0.5250 | 0.0000 |
| 3.0808 | 0.5275 | 0.0000 |
| 3.1580 | 0.5300 | 0.0000 |
| 3.2240 | 0.5316 | 0.0000 |
| 3.2781 | 0.5227 | 0.0000 |
| 3.3183 | 0.5023 | 0.0000 |
| 3.3455 | 0.4786 | 0.0000 |
| 3.3625 | 0.4567 | 0.0000 |
| 3.3727 | 0.4385 | 0.0000 |
| 3.3794 | 0.4226 | 0.0000 |
| 3.3836 | 0.4094 | 0.0000 |
| 3.3860 | 0.3992 | 0.0000 |
| 3.3879 | 0.3881 | 0.0000 |
| 3.3892 | 0.3732 | 0.0000 |
| 3.3890 | 0.3546 | 0.0000 |
| 3.3859 | 0.3322 | 0.0000 |
| 3.3773 | 0.3037 | 0.0000 |
| 3.3586 | 0.2695 | 0.0000 |
| 3.3250 | 0.2345 | 0.0000 |
| 3.2728 | 0.2071 | 0.0000 |
| 3.2069 | 0.1816 | 0.0000 |
| 3.1298 | 0.1519 | 0.0000 |
| 3.0389 | 0.1164 | 0.0000 |
| 2.9340 | 0.0751 | 0.0000 |
| 2.8145 | 0.0301 | 0.0000 |
| 2.6802 | −0.0183 | 0.0000 |
| 2.5313 | −0.0706 | 0.0000 |
| 2.3676 | −0.1258 | 0.0000 |
| 2.1961 | −0.1816 | 0.0000 |
| 2.0174 | −0.2392 | 0.0000 |
| 1.8309 | −0.2972 | 0.0000 |
| 1.6360 | −0.3535 | 0.0000 |
| 1.4327 | −0.4076 | 0.0000 |
| 1.2210 | −0.4593 | 0.0000 |
| 1.0010 | −0.5080 | 0.0000 |
| 0.7798 | −0.5505 | 0.0000 |
| 0.5572 | −0.5863 | 0.0000 |
| 0.3336 | −0.6153 | 0.0000 |
| 0.1095 | −0.6369 | 0.0000 |
| −0.1152 | −0.6510 | 0.0000 |
| −0.3404 | −0.6568 | 0.0000 |
| −0.5658 | −0.6520 | 0.0000 |
| −0.7892 | −0.6359 | 0.0000 |
| −1.0106 | −0.6086 | 0.0000 |
| −1.2299 | −0.5699 | 0.0000 |
| −1.4473 | −0.5203 | 0.0000 |
| −1.6557 | −0.4625 | 0.0000 |
| −1.8552 | −0.3979 | 0.0000 |
| −2.0456 | −0.3279 | 0.0000 |
| −2.2264 | −0.2545 | 0.0000 |
| −2.3986 | −0.1796 | 0.0000 |
| −2.5621 | −0.1036 | 0.0000 |
| −2.7169 | −0.0270 | 0.0000 |
| −2.8640 | 0.0481 | 0.0000 |
| −2.9965 | 0.1188 | 0.0000 |
| −3.1149 | 0.1841 | 0.0000 |
| −3.2192 | 0.2439 | 0.0000 |
| −3.3148 | 0.3035 | 0.0000 |
| −3.3936 | 0.3611 | 0.0000 |
| −3.4494 | 0.4112 | 0.0000 |
| −3.4884 | 0.4567 | 0.0000 |
| −3.5117 | 0.4954 | 0.0000 |
| −3.5224 | 0.5273 | 0.0000 |
| −3.5238 | 0.5461 | 0.0000 |
| −3.5223 | 0.5581 | 0.0000 |
| −3.5207 | 0.5639 | 0.0000 |
| −3.5196 | 0.5668 | 0.0000 |
| −3.4507 | 0.6509 | 0.6200 |
| −3.4502 | 0.6522 | 0.6200 |
| −3.4490 | 0.6547 | 0.6200 |
| −3.4466 | 0.6597 | 0.6200 |
| −3.4407 | 0.6691 | 0.6200 |
| −3.4293 | 0.6823 | 0.6200 |
| −3.4043 | 0.7009 | 0.6200 |
| −3.3656 | 0.7160 | 0.6200 |
| −3.3106 | 0.7226 | 0.6200 |
| −3.2418 | 0.7166 | 0.6200 |

TABLE A-continued

| X | Y | Z |
|---|---|---|
| −3.1530 | 0.7006 | 0.6200 |
| −3.0506 | 0.6822 | 0.6200 |
| −2.9412 | 0.6632 | 0.6200 |
| −2.8181 | 0.6421 | 0.6200 |
| −2.6813 | 0.6192 | 0.6200 |
| −2.5306 | 0.5950 | 0.6200 |
| −2.3730 | 0.5701 | 0.6200 |
| −2.2085 | 0.5447 | 0.6200 |
| −2.0370 | 0.5191 | 0.6200 |
| −1.8585 | 0.4938 | 0.6200 |
| −1.6729 | 0.4693 | 0.6200 |
| −1.4800 | 0.4462 | 0.6200 |
| −1.2799 | 0.4252 | 0.6200 |
| −1.0724 | 0.4073 | 0.6200 |
| −0.8646 | 0.3931 | 0.6200 |
| −0.6566 | 0.3826 | 0.6200 |
| −0.4485 | 0.3752 | 0.6200 |
| −0.2403 | 0.3690 | 0.6200 |
| −0.0321 | 0.3637 | 0.6200 |
| 0.1762 | 0.3611 | 0.6200 |
| 0.3844 | 0.3610 | 0.6200 |
| 0.5927 | 0.3620 | 0.6200 |
| 0.8010 | 0.3625 | 0.6200 |
| 1.0093 | 0.3631 | 0.6200 |
| 1.2176 | 0.3639 | 0.6200 |
| 1.4190 | 0.3640 | 0.6200 |
| 1.6134 | 0.3626 | 0.6200 |
| 1.8009 | 0.3615 | 0.6200 |
| 1.9814 | 0.3616 | 0.6200 |
| 2.1550 | 0.3610 | 0.6200 |
| 2.3216 | 0.3599 | 0.6200 |
| 2.4813 | 0.3593 | 0.6200 |
| 2.6271 | 0.3583 | 0.6200 |
| 2.7590 | 0.3560 | 0.6200 |
| 2.8771 | 0.3546 | 0.6200 |
| 2.9812 | 0.3537 | 0.6200 |
| 3.0715 | 0.3520 | 0.6200 |
| 3.1478 | 0.3499 | 0.6200 |
| 3.2130 | 0.3474 | 0.6200 |
| 3.2676 | 0.3434 | 0.6200 |
| 3.3092 | 0.3271 | 0.6200 |
| 3.3374 | 0.3052 | 0.6200 |
| 3.3548 | 0.2840 | 0.6200 |
| 3.3651 | 0.2660 | 0.6200 |
| 3.3715 | 0.2501 | 0.6200 |
| 3.3753 | 0.2368 | 0.6200 |
| 3.3773 | 0.2267 | 0.6200 |
| 3.3786 | 0.2157 | 0.6200 |
| 3.3790 | 0.2011 | 0.6200 |
| 3.3773 | 0.1828 | 0.6200 |
| 3.3722 | 0.1614 | 0.6200 |
| 3.3605 | 0.1346 | 0.6200 |
| 3.3373 | 0.1044 | 0.6200 |
| 3.2983 | 0.0774 | 0.6200 |
| 3.2435 | 0.0578 | 0.6200 |
| 3.1779 | 0.0357 | 0.6200 |
| 3.1010 | 0.0101 | 0.6200 |
| 3.0098 | −0.0191 | 0.6200 |
| 2.9040 | −0.0512 | 0.6200 |
| 2.7844 | −0.0881 | 0.6200 |
| 2.6504 | −0.1288 | 0.6200 |
| 2.5017 | −0.1714 | 0.6200 |
| 2.3386 | −0.2171 | 0.6200 |
| 2.1680 | −0.2636 | 0.6200 |
| 1.9896 | −0.3094 | 0.6200 |
| 1.8035 | −0.3548 | 0.6200 |
| 1.6100 | −0.4006 | 0.6200 |
| 1.4084 | −0.4443 | 0.6200 |
| 1.1986 | −0.4845 | 0.6200 |
| 0.9808 | −0.5215 | 0.6200 |
| 0.7622 | −0.5533 | 0.6200 |
| 0.5426 | −0.5783 | 0.6200 |
| 0.3224 | −0.5956 | 0.6200 |
| 0.1019 | −0.6061 | 0.6200 |
| −0.1190 | −0.6097 | 0.6200 |
| −0.3395 | −0.6048 | 0.6200 |
| −0.5581 | −0.5889 | 0.6200 |
| −0.7749 | −0.5622 | 0.6200 |

TABLE A-continued

| X | Y | Z |
|---|---|---|
| −0.9898 | −0.5253 | 0.6200 |
| −1.2030 | −0.4782 | 0.6200 |
| −1.4145 | −0.4212 | 0.6200 |
| −1.6174 | −0.3576 | 0.6200 |
| −1.8115 | −0.2888 | 0.6200 |
| −1.9962 | −0.2164 | 0.6200 |
| −2.1722 | −0.1419 | 0.6200 |
| −2.3400 | −0.0668 | 0.6200 |
| −2.4997 | 0.0082 | 0.6200 |
| −2.6516 | 0.0828 | 0.6200 |
| −2.7961 | 0.1555 | 0.6200 |
| −2.9266 | 0.2233 | 0.6200 |
| −3.0434 | 0.2856 | 0.6200 |
| −3.1465 | 0.3424 | 0.6200 |
| −3.2414 | 0.3985 | 0.6200 |
| −3.3203 | 0.4526 | 0.6200 |
| −3.3766 | 0.4999 | 0.6200 |
| −3.4165 | 0.5430 | 0.6200 |
| −3.4408 | 0.5799 | 0.6200 |
| −3.4526 | 0.6108 | 0.6200 |
| −3.4548 | 0.6291 | 0.6200 |
| −3.4537 | 0.6409 | 0.6200 |
| −3.4522 | 0.6466 | 0.6200 |
| −3.4512 | 0.6495 | 0.6200 |
| −3.3957 | 0.7329 | 1.2236 |
| −3.3952 | 0.7342 | 1.2236 |
| −3.3941 | 0.7368 | 1.2236 |
| −3.3916 | 0.7417 | 1.2236 |
| −3.3856 | 0.7509 | 1.2236 |
| −3.3737 | 0.7636 | 1.2236 |
| −3.3477 | 0.7805 | 1.2236 |
| −3.3083 | 0.7927 | 1.2236 |
| −3.2534 | 0.7955 | 1.2236 |
| −3.1851 | 0.7866 | 1.2236 |
| −3.0969 | 0.7702 | 1.2236 |
| −2.9951 | 0.7516 | 1.2236 |
| −2.8864 | 0.7324 | 1.2236 |
| −2.7640 | 0.7110 | 1.2236 |
| −2.6280 | 0.6876 | 1.2236 |
| −2.4784 | 0.6622 | 1.2236 |
| −2.3219 | 0.6355 | 1.2236 |
| −2.1587 | 0.6074 | 1.2236 |
| −1.9887 | 0.5781 | 1.2236 |
| −1.8119 | 0.5478 | 1.2236 |
| −1.6282 | 0.5168 | 1.2236 |
| −1.4375 | 0.4858 | 1.2236 |
| −1.2397 | 0.4556 | 1.2236 |
| −1.0346 | 0.4272 | 1.2236 |
| −0.8290 | 0.4022 | 1.2236 |
| −0.6231 | 0.3809 | 1.2236 |
| −0.4168 | 0.3633 | 1.2236 |
| −0.2104 | 0.3473 | 1.2236 |
| −0.0039 | 0.3323 | 1.2236 |
| 0.2028 | 0.3199 | 1.2236 |
| 0.4096 | 0.3109 | 1.2236 |
| 0.6165 | 0.3031 | 1.2236 |
| 0.8234 | 0.2948 | 1.2236 |
| 1.0303 | 0.2867 | 1.2236 |
| 1.2372 | 0.2788 | 1.2236 |
| 1.4372 | 0.2703 | 1.2236 |
| 1.6302 | 0.2601 | 1.2236 |
| 1.8164 | 0.2508 | 1.2236 |
| 1.9957 | 0.2434 | 1.2236 |
| 2.1680 | 0.2351 | 1.2236 |
| 2.3334 | 0.2257 | 1.2236 |
| 2.4920 | 0.2177 | 1.2236 |
| 2.6368 | 0.2100 | 1.2236 |
| 2.7676 | 0.2013 | 1.2236 |
| 2.8847 | 0.1943 | 1.2236 |
| 2.9881 | 0.1892 | 1.2236 |
| 3.0777 | 0.1831 | 1.2236 |
| 3.1534 | 0.1769 | 1.2236 |
| 3.2180 | 0.1713 | 1.2236 |
| 3.2724 | 0.1670 | 1.2236 |
| 3.3158 | 0.1577 | 1.2236 |
| 3.3460 | 0.1391 | 1.2236 |
| 3.3647 | 0.1190 | 1.2236 |
| 3.3753 | 0.1015 | 1.2236 |

TABLE A-continued

| X | Y | Z |
|---|---|---|
| 3.3818 | 0.0856 | 1.2236 |
| 3.3852 | 0.0724 | 1.2236 |
| 3.3867 | 0.0622 | 1.2236 |
| 3.3874 | 0.0514 | 1.2236 |
| 3.3867 | 0.0370 | 1.2236 |
| 3.3834 | 0.0193 | 1.2236 |
| 3.3759 | −0.0009 | 1.2236 |
| 3.3601 | −0.0250 | 1.2236 |
| 3.3317 | −0.0492 | 1.2236 |
| 3.2878 | −0.0655 | 1.2236 |
| 3.2327 | −0.0811 | 1.2236 |
| 3.1672 | −0.0999 | 1.2236 |
| 3.0904 | −0.1214 | 1.2236 |
| 2.9992 | −0.1450 | 1.2236 |
| 2.8935 | −0.1705 | 1.2236 |
| 2.7741 | −0.2007 | 1.2236 |
| 2.6406 | −0.2341 | 1.2236 |
| 2.4923 | −0.2684 | 1.2236 |
| 2.3298 | −0.3055 | 1.2236 |
| 2.1601 | −0.3435 | 1.2236 |
| 1.9826 | −0.3795 | 1.2236 |
| 1.7976 | −0.4148 | 1.2236 |
| 1.6054 | −0.4510 | 1.2236 |
| 1.4053 | −0.4850 | 1.2236 |
| 1.1972 | −0.5152 | 1.2236 |
| 0.9815 | −0.5420 | 1.2236 |
| 0.7653 | −0.5638 | 1.2236 |
| 0.5486 | −0.5790 | 1.2236 |
| 0.3311 | −0.5862 | 1.2236 |
| 0.1135 | −0.5867 | 1.2236 |
| −0.1038 | −0.5806 | 1.2236 |
| −0.3205 | −0.5658 | 1.2236 |
| −0.5368 | −0.5400 | 1.2236 |
| −0.7515 | −0.5033 | 1.2236 |
| −0.9639 | −0.4569 | 1.2236 |
| −1.1741 | −0.4011 | 1.2236 |
| −1.3821 | −0.3365 | 1.2236 |
| −1.5809 | −0.2667 | 1.2236 |
| −1.7705 | −0.1936 | 1.2236 |
| −1.9515 | −0.1184 | 1.2236 |
| −2.1243 | −0.0420 | 1.2236 |
| −2.2893 | 0.0340 | 1.2236 |
| −2.4467 | 0.1089 | 1.2236 |
| −2.5968 | 0.1825 | 1.2236 |
| −2.7399 | 0.2538 | 1.2236 |
| −2.8693 | 0.3200 | 1.2236 |
| −2.9851 | 0.3807 | 1.2236 |
| −3.0876 | 0.4357 | 1.2236 |
| −3.1824 | 0.4895 | 1.2236 |
| −3.2615 | 0.5411 | 1.2236 |
| −3.3183 | 0.5863 | 1.2236 |
| −3.3588 | 0.6277 | 1.2236 |
| −3.3840 | 0.6633 | 1.2236 |
| −3.3967 | 0.6934 | 1.2236 |
| −3.3994 | 0.7114 | 1.2236 |
| −3.3985 | 0.7230 | 1.2236 |
| −3.3972 | 0.7287 | 1.2236 |
| −3.3962 | 0.7315 | 1.2236 |
| −3.3433 | 0.8786 | 2.3440 |
| −3.3428 | 0.8799 | 2.3440 |
| −3.3416 | 0.8824 | 2.3440 |
| −3.3388 | 0.8873 | 2.3440 |
| −3.3319 | 0.8961 | 2.3440 |
| −3.3185 | 0.9073 | 2.3440 |
| −3.2900 | 0.9202 | 2.3440 |
| −3.2487 | 0.9259 | 2.3440 |
| −3.1933 | 0.9209 | 2.3440 |
| −3.1251 | 0.9069 | 2.3440 |
| −3.0365 | 0.8884 | 2.3440 |
| −2.9342 | 0.8681 | 2.3440 |
| −2.8248 | 0.8471 | 2.3440 |
| −2.7017 | 0.8241 | 2.3440 |
| −2.5647 | 0.7991 | 2.3440 |
| −2.4141 | 0.7718 | 2.3440 |
| −2.2567 | 0.7430 | 2.3440 |
| −2.0925 | 0.7124 | 2.3440 |
| −1.9216 | 0.6799 | 2.3440 |
| −1.7440 | 0.6450 | 2.3440 |

TABLE A-continued

| X | Y | Z |
|---|---|---|
| −1.5600 | 0.6071 | 2.3440 |
| −1.3695 | 0.5665 | 2.3440 |
| −1.1722 | 0.5237 | 2.3440 |
| −0.9682 | 0.4795 | 2.3440 |
| −0.7641 | 0.4360 | 2.3440 |
| −0.5596 | 0.3941 | 2.3440 |
| −0.3546 | 0.3547 | 2.3440 |
| −0.1491 | 0.3184 | 2.3440 |
| 0.0569 | 0.2855 | 2.3440 |
| 0.2635 | 0.2563 | 2.3440 |
| 0.4705 | 0.2306 | 2.3440 |
| 0.6778 | 0.2073 | 2.3440 |
| 0.8853 | 0.1848 | 2.3440 |
| 1.0926 | 0.1612 | 2.3440 |
| 1.2999 | 0.1371 | 2.3440 |
| 1.5003 | 0.1140 | 2.3440 |
| 1.6937 | 0.0910 | 2.3440 |
| 1.8801 | 0.0678 | 2.3440 |
| 2.0594 | 0.0446 | 2.3440 |
| 2.2318 | 0.0218 | 2.3440 |
| 2.3973 | −0.0004 | 2.3440 |
| 2.5557 | −0.0223 | 2.3440 |
| 2.7004 | −0.0426 | 2.3440 |
| 2.8313 | −0.0609 | 2.3440 |
| 2.9482 | −0.0787 | 2.3440 |
| 3.0510 | −0.0967 | 2.3440 |
| 3.1401 | −0.1118 | 2.3440 |
| 3.2157 | −0.1236 | 2.3440 |
| 3.2804 | −0.1332 | 2.3440 |
| 3.3348 | −0.1414 | 2.3440 |
| 3.3795 | −0.1483 | 2.3440 |
| 3.4150 | −0.1545 | 2.3440 |
| 3.4397 | −0.1674 | 2.3440 |
| 3.4541 | −0.1829 | 2.3440 |
| 3.4623 | −0.1985 | 2.3440 |
| 3.4660 | −0.2120 | 2.3440 |
| 3.4670 | −0.2226 | 2.3440 |
| 3.4665 | −0.2334 | 2.3440 |
| 3.4632 | −0.2474 | 2.3440 |
| 3.4553 | −0.2634 | 2.3440 |
| 3.4408 | −0.2793 | 2.3440 |
| 3.4152 | −0.2922 | 2.3440 |
| 3.3781 | −0.2991 | 2.3440 |
| 3.3317 | −0.3070 | 2.3440 |
| 3.2752 | −0.3165 | 2.3440 |
| 3.2080 | −0.3278 | 2.3440 |
| 3.1294 | −0.3416 | 2.3440 |
| 3.0369 | −0.3594 | 2.3440 |
| 2.9300 | −0.3798 | 2.3440 |
| 2.8085 | −0.4001 | 2.3440 |
| 2.6725 | −0.4215 | 2.3440 |
| 2.5221 | −0.4451 | 2.3440 |
| 2.3573 | −0.4699 | 2.3440 |
| 2.1851 | −0.4946 | 2.3440 |
| 2.0056 | −0.5191 | 2.3440 |
| 1.8186 | −0.5425 | 2.3440 |
| 1.6242 | −0.5639 | 2.3440 |
| 1.4221 | −0.5826 | 2.3440 |
| 1.2125 | −0.5979 | 2.3440 |
| 0.9957 | −0.6094 | 2.3440 |
| 0.7788 | −0.6143 | 2.3440 |
| 0.5618 | −0.6119 | 2.3440 |
| 0.3446 | −0.6028 | 2.3440 |
| 0.1276 | −0.5864 | 2.3440 |
| −0.0884 | −0.5616 | 2.3440 |
| −0.3032 | −0.5271 | 2.3440 |
| −0.5160 | −0.4828 | 2.3440 |
| −0.7261 | −0.4290 | 2.3440 |
| −0.9337 | −0.3661 | 2.3440 |
| −1.1389 | −0.2950 | 2.3440 |
| −1.3419 | −0.2169 | 2.3440 |
| −1.5361 | −0.1365 | 2.3440 |
| −1.7221 | −0.0554 | 2.3440 |
| −1.9003 | 0.0255 | 2.3440 |
| −2.0709 | 0.1058 | 2.3440 |
| −2.2342 | 0.1845 | 2.3440 |
| −2.3906 | 0.2608 | 2.3440 |
| −2.5399 | 0.3350 | 2.3440 |

TABLE A-continued

| X | Y | Z |
|---|---|---|
| −2.6824 | 0.4067 | 2.3440 |
| −2.8114 | 0.4730 | 2.3440 |
| −2.9269 | 0.5337 | 2.3440 |
| −3.0291 | 0.5886 | 2.3440 |
| −3.1241 | 0.6415 | 2.3440 |
| −3.2041 | 0.6913 | 2.3440 |
| −3.2619 | 0.7350 | 2.3440 |
| −3.3035 | 0.7751 | 2.3440 |
| −3.3298 | 0.8098 | 2.3440 |
| −3.3435 | 0.8393 | 2.3440 |
| −3.3468 | 0.8572 | 2.3440 |
| −3.3461 | 0.8688 | 2.3440 |
| −3.3448 | 0.8745 | 2.3440 |
| −3.3439 | 0.8772 | 2.3440 |
| −3.3385 | 0.9138 | 2.6600 |
| −3.3380 | 0.9151 | 2.6600 |
| −3.3367 | 0.9176 | 2.6600 |
| −3.3338 | 0.9224 | 2.6600 |
| −3.3267 | 0.9311 | 2.6600 |
| −3.3128 | 0.9418 | 2.6600 |
| −3.2835 | 0.9531 | 2.6600 |
| −3.2418 | 0.9567 | 2.6600 |
| −3.1864 | 0.9494 | 2.6600 |
| −3.1182 | 0.9342 | 2.6600 |
| −3.0293 | 0.9151 | 2.6600 |
| −2.9267 | 0.8940 | 2.6600 |
| −2.8170 | 0.8723 | 2.6600 |
| −2.6935 | 0.8485 | 2.6600 |
| −2.5561 | 0.8228 | 2.6600 |
| −2.4049 | 0.7949 | 2.6600 |
| −2.2469 | 0.7654 | 2.6600 |
| −2.0822 | 0.7340 | 2.6600 |
| −1.9107 | 0.7005 | 2.6600 |
| −1.7326 | 0.6645 | 2.6600 |
| −1.5481 | 0.6253 | 2.6600 |
| −1.3572 | 0.5829 | 2.6600 |
| −1.1596 | 0.5377 | 2.6600 |
| −0.9554 | 0.4903 | 2.6600 |
| −0.7512 | 0.4431 | 2.6600 |
| −0.5468 | 0.3967 | 2.6600 |
| −0.3420 | 0.3523 | 2.6600 |
| −0.1365 | 0.3109 | 2.6600 |
| 0.0697 | 0.2731 | 2.6600 |
| 0.2766 | 0.2392 | 2.6600 |
| 0.4841 | 0.2090 | 2.6600 |
| 0.6920 | 0.1817 | 2.6600 |
| 0.9001 | 0.1559 | 2.6600 |
| 1.1081 | 0.1291 | 2.6600 |
| 1.3159 | 0.1015 | 2.6600 |
| 1.5169 | 0.0748 | 2.6600 |
| 1.7107 | 0.0481 | 2.6600 |
| 1.8975 | 0.0212 | 2.6600 |
| 2.0773 | −0.0055 | 2.6600 |
| 2.2500 | −0.0316 | 2.6600 |
| 2.4158 | −0.0573 | 2.6600 |
| 2.5744 | −0.0832 | 2.6600 |
| 2.7192 | −0.1073 | 2.6600 |
| 2.8504 | −0.1278 | 2.6600 |
| 2.9676 | −0.1478 | 2.6600 |
| 3.0703 | −0.1689 | 2.6600 |
| 3.1596 | −0.1862 | 2.6600 |
| 3.2355 | −0.1989 | 2.6600 |
| 3.3004 | −0.2091 | 2.6600 |
| 3.3550 | −0.2180 | 2.6600 |
| 3.3998 | −0.2260 | 2.6600 |
| 3.4355 | −0.2329 | 2.6600 |
| 3.4616 | −0.2430 | 2.6600 |
| 3.4772 | −0.2576 | 2.6600 |
| 3.4861 | −0.2730 | 2.6600 |
| 3.4899 | −0.2867 | 2.6600 |
| 3.4908 | −0.2974 | 2.6600 |
| 3.4899 | −0.3082 | 2.6600 |
| 3.4859 | −0.3221 | 2.6600 |
| 3.4766 | −0.3375 | 2.6600 |
| 3.4603 | −0.3516 | 2.6600 |
| 3.4330 | −0.3606 | 2.6600 |
| 3.3956 | −0.3666 | 2.6600 |
| 3.3489 | −0.3734 | 2.6600 |

TABLE A-continued

| X | Y | Z |
|---|---|---|
| 3.2919 | −0.3810 | 2.6600 |
| 3.2241 | −0.3897 | 2.6600 |
| 3.1449 | −0.4009 | 2.6600 |
| 3.0518 | −0.4169 | 2.6600 |
| 2.9443 | −0.4354 | 2.6600 |
| 2.8219 | −0.4522 | 2.6600 |
| 2.6850 | −0.4702 | 2.6600 |
| 2.5338 | −0.4912 | 2.6600 |
| 2.3681 | −0.5131 | 2.6600 |
| 2.1949 | −0.5341 | 2.6600 |
| 2.0145 | −0.5548 | 2.6600 |
| 1.8267 | −0.5746 | 2.6600 |
| 1.6314 | −0.5925 | 2.6600 |
| 1.4287 | −0.6075 | 2.6600 |
| 1.2183 | −0.6190 | 2.6600 |
| 1.0004 | −0.6265 | 2.6600 |
| 0.7822 | −0.6273 | 2.6600 |
| 0.5643 | −0.6207 | 2.6600 |
| 0.3467 | −0.6076 | 2.6600 |
| 0.1295 | −0.5869 | 2.6600 |
| −0.0863 | −0.5572 | 2.6600 |
| −0.3005 | −0.5177 | 2.6600 |
| −0.5130 | −0.4684 | 2.6600 |
| −0.7226 | −0.4100 | 2.6600 |
| −0.9292 | −0.3431 | 2.6600 |
| −1.1333 | −0.2688 | 2.6600 |
| −1.3352 | −0.1882 | 2.6600 |
| −1.5289 | −0.1059 | 2.6600 |
| −1.7146 | −0.0233 | 2.6600 |
| −1.8927 | 0.0586 | 2.6600 |
| −2.0632 | 0.1395 | 2.6600 |
| −2.2265 | 0.2186 | 2.6600 |
| −2.3830 | 0.2954 | 2.6600 |
| −2.5324 | 0.3700 | 2.6600 |
| −2.6749 | 0.4421 | 2.6600 |
| −2.8039 | 0.5087 | 2.6600 |
| −2.9195 | 0.5696 | 2.6600 |
| −3.0217 | 0.6248 | 2.6600 |
| −3.1168 | 0.6778 | 2.6600 |
| −3.1971 | 0.7274 | 2.6600 |
| −3.2554 | 0.7707 | 2.6600 |
| −3.2976 | 0.8105 | 2.6600 |
| −3.3243 | 0.8450 | 2.6600 |
| −3.3384 | 0.8744 | 2.6600 |
| −3.3420 | 0.8922 | 2.6600 |
| −3.3414 | 0.9039 | 2.6600 |
| −3.3400 | 0.9096 | 2.6600 |
| −3.3391 | 0.9124 | 2.6600 |
| −3.3159 | 1.0297 | 3.6230 |
| −3.3152 | 1.0310 | 3.6230 |
| −3.3139 | 1.0335 | 3.6230 |
| −3.3107 | 1.0382 | 3.6230 |
| −3.3026 | 1.0462 | 3.6230 |
| −3.2872 | 1.0550 | 3.6230 |
| −3.2561 | 1.0619 | 3.6230 |
| −3.2139 | 1.0593 | 3.6230 |
| −3.1589 | 1.0463 | 3.6230 |
| −3.0906 | 1.0283 | 3.6230 |
| −3.0014 | 1.0061 | 3.6230 |
| −2.8983 | 0.9819 | 3.6230 |
| −2.7881 | 0.9570 | 3.6230 |
| −2.6639 | 0.9297 | 3.6230 |
| −2.5257 | 0.9003 | 3.6230 |
| −2.3736 | 0.8685 | 3.6230 |
| −2.2146 | 0.8351 | 3.6230 |
| −2.0488 | 0.7997 | 3.6230 |
| −1.8764 | 0.7620 | 3.6230 |
| −1.6973 | 0.7216 | 3.6230 |
| −1.5118 | 0.6777 | 3.6230 |
| −1.3200 | 0.6298 | 3.6230 |
| −1.1219 | 0.5781 | 3.6230 |
| −0.9175 | 0.5225 | 3.6230 |
| −0.7136 | 0.4653 | 3.6230 |
| −0.5099 | 0.4068 | 3.6230 |
| −0.3061 | 0.3485 | 3.6230 |
| −0.1019 | 0.2919 | 3.6230 |
| 0.1030 | 0.2385 | 3.6230 |
| 0.3090 | 0.1892 | 3.6230 |

TABLE A-continued

| X | Y | Z |
|---|---|---|
| 0.5160 | 0.1441 | 3.6230 |
| 0.7239 | 0.1029 | 3.6230 |
| 0.9323 | 0.0647 | 3.6230 |
| 1.1408 | 0.0267 | 3.6230 |
| 1.3492 | −0.0119 | 3.6230 |
| 1.5505 | −0.0499 | 3.6230 |
| 1.7446 | −0.0876 | 3.6230 |
| 1.9316 | −0.1251 | 3.6230 |
| 2.1114 | −0.1625 | 3.6230 |
| 2.2841 | −0.1993 | 3.6230 |
| 2.4497 | −0.2354 | 3.6230 |
| 2.6081 | −0.2717 | 3.6230 |
| 2.7526 | −0.3052 | 3.6230 |
| 2.8838 | −0.3336 | 3.6230 |
| 3.0010 | −0.3599 | 3.6230 |
| 3.1035 | −0.3866 | 3.6230 |
| 3.1924 | −0.4094 | 3.6230 |
| 3.2681 | −0.4268 | 3.6230 |
| 3.3329 | −0.4413 | 3.6230 |
| 3.3872 | −0.4539 | 3.6230 |
| 3.4318 | −0.4649 | 3.6230 |
| 3.4673 | −0.4743 | 3.6230 |
| 3.4944 | −0.4822 | 3.6230 |
| 3.5117 | −0.4942 | 3.6230 |
| 3.5216 | −0.5090 | 3.6230 |
| 3.5255 | −0.5227 | 3.6230 |
| 3.5258 | −0.5333 | 3.6230 |
| 3.5240 | −0.5440 | 3.6230 |
| 3.5180 | −0.5571 | 3.6230 |
| 3.5056 | −0.5703 | 3.6230 |
| 3.4858 | −0.5788 | 3.6230 |
| 3.4568 | −0.5819 | 3.6230 |
| 3.4191 | −0.5853 | 3.6230 |
| 3.3718 | −0.5888 | 3.6230 |
| 3.3144 | −0.5922 | 3.6230 |
| 3.2460 | −0.5958 | 3.6230 |
| 3.1660 | −0.6009 | 3.6230 |
| 3.0716 | −0.6094 | 3.6230 |
| 2.9626 | −0.6190 | 3.6230 |
| 2.8389 | −0.6257 | 3.6230 |
| 2.7005 | −0.6335 | 3.6230 |
| 2.5478 | −0.6443 | 3.6230 |
| 2.3804 | −0.6552 | 3.6230 |
| 2.2057 | −0.6649 | 3.6230 |
| 2.0237 | −0.6739 | 3.6230 |
| 1.8343 | −0.6815 | 3.6230 |
| 1.6375 | −0.6867 | 3.6230 |
| 1.4333 | −0.6891 | 3.6230 |
| 1.2220 | −0.6879 | 3.6230 |
| 1.0036 | −0.6818 | 3.6230 |
| 0.7855 | −0.6691 | 3.6230 |
| 0.5678 | −0.6492 | 3.6230 |
| 0.3506 | −0.6222 | 3.6230 |
| 0.1350 | −0.5868 | 3.6230 |
| −0.0786 | −0.5418 | 3.6230 |
| −0.2901 | −0.4870 | 3.6230 |
| −0.4995 | −0.4231 | 3.6230 |
| −0.7062 | −0.3513 | 3.6230 |
| −0.9104 | −0.2732 | 3.6230 |
| −1.1127 | −0.1900 | 3.6230 |
| −1.3135 | −0.1029 | 3.6230 |
| −1.5064 | −0.0159 | 3.6230 |
| −1.6916 | 0.0702 | 3.6230 |
| −1.8694 | 0.1551 | 3.6230 |
| −2.0397 | 0.2386 | 3.6230 |
| −2.2029 | 0.3200 | 3.6230 |
| −2.3592 | 0.3991 | 3.6230 |
| −2.5082 | 0.4762 | 3.6230 |
| −2.6504 | 0.5508 | 3.6230 |
| −2.7791 | 0.6195 | 3.6230 |
| −2.8944 | 0.6824 | 3.6230 |
| −2.9963 | 0.7394 | 3.6230 |
| −3.0911 | 0.7941 | 3.6230 |
| −3.1717 | 0.8442 | 3.6230 |
| −3.2305 | 0.8874 | 3.6230 |
| −3.2732 | 0.9269 | 3.6230 |
| −3.3006 | 0.9611 | 3.6230 |
| −3.3154 | 0.9903 | 3.6230 |

TABLE A-continued

| X | Y | Z |
|---|---|---|
| −3.3193 | 1.0082 | 3.6230 |
| −3.3189 | 1.0199 | 3.6230 |
| −3.3175 | 1.0256 | 3.6230 |
| −3.3164 | 1.0284 | 3.6230 |
| −3.2843 | 1.2601 | 5.3470 |
| −3.2836 | 1.2614 | 5.3470 |
| −3.2820 | 1.2638 | 5.3470 |
| −3.2780 | 1.2681 | 5.3470 |
| −3.2682 | 1.2744 | 5.3470 |
| −3.2507 | 1.2791 | 5.3470 |
| −3.2182 | 1.2776 | 5.3470 |
| −3.1764 | 1.2659 | 5.3470 |
| −3.1218 | 1.2468 | 5.3470 |
| −3.0533 | 1.2236 | 5.3470 |
| −2.9640 | 1.1946 | 5.3470 |
| −2.8604 | 1.1627 | 5.3470 |
| −2.7495 | 1.1299 | 5.3470 |
| −2.6245 | 1.0940 | 5.3470 |
| −2.4854 | 1.0549 | 5.3470 |
| −2.3323 | 1.0121 | 5.3470 |
| −2.1722 | 0.9675 | 5.3470 |
| −2.0051 | 0.9209 | 5.3470 |
| −1.8312 | 0.8720 | 5.3470 |
| −1.6507 | 0.8198 | 5.3470 |
| −1.4639 | 0.7634 | 5.3470 |
| −1.2709 | 0.7026 | 5.3470 |
| −1.0717 | 0.6372 | 5.3470 |
| −0.8667 | 0.5666 | 5.3470 |
| −0.6628 | 0.4928 | 5.3470 |
| −0.4601 | 0.4158 | 5.3470 |
| −0.2583 | 0.3366 | 5.3470 |
| −0.0568 | 0.2563 | 5.3470 |
| 0.1448 | 0.1766 | 5.3470 |
| 0.3471 | 0.0987 | 5.3470 |
| 0.5506 | 0.0239 | 5.3470 |
| 0.7555 | −0.0473 | 5.3470 |
| 0.9616 | −0.1149 | 5.3470 |
| 1.1687 | −0.1795 | 5.3470 |
| 1.3763 | −0.2426 | 5.3470 |
| 1.5771 | −0.3032 | 5.3470 |
| 1.7710 | −0.3614 | 5.3470 |
| 1.9578 | −0.4183 | 5.3470 |
| 2.1371 | −0.4748 | 5.3470 |
| 2.3092 | −0.5302 | 5.3470 |
| 2.4742 | −0.5837 | 5.3470 |
| 2.6323 | −0.6357 | 5.3470 |
| 2.7764 | −0.6835 | 5.3470 |
| 2.9067 | −0.7270 | 5.3470 |
| 3.0232 | −0.7661 | 5.3470 |
| 3.1259 | −0.8010 | 5.3470 |
| 3.2148 | −0.8316 | 5.3470 |
| 3.2900 | −0.8576 | 5.3470 |
| 3.3542 | −0.8800 | 5.3470 |
| 3.4081 | −0.8989 | 5.3470 |
| 3.4524 | −0.9144 | 5.3470 |
| 3.4879 | −0.9269 | 5.3470 |
| 3.5152 | −0.9364 | 5.3470 |
| 3.5347 | −0.9456 | 5.3470 |
| 3.5457 | −0.9596 | 5.3470 |
| 3.5495 | −0.9733 | 5.3470 |
| 3.5491 | −0.9841 | 5.3470 |
| 3.5456 | −0.9945 | 5.3470 |
| 3.5368 | −1.0061 | 5.3470 |
| 3.5207 | −1.0145 | 5.3470 |
| 3.4987 | −1.0149 | 5.3470 |
| 3.4692 | −1.0129 | 5.3470 |
| 3.4309 | −1.0104 | 5.3470 |
| 3.3830 | −1.0073 | 5.3470 |
| 3.3248 | −1.0036 | 5.3470 |
| 3.2555 | −0.9991 | 5.3470 |
| 3.1745 | −0.9939 | 5.3470 |
| 3.0787 | −0.9874 | 5.3470 |
| 2.9682 | −0.9797 | 5.3470 |
| 2.8430 | −0.9707 | 5.3470 |
| 2.7031 | −0.9606 | 5.3470 |
| 2.5485 | −0.9493 | 5.3470 |
| 2.3792 | −0.9364 | 5.3470 |
| 2.2025 | −0.9223 | 5.3470 |

TABLE A-continued

| X | Y | Z |
|---|---|---|
| 2.0186 | −0.9071 | 5.3470 |
| 1.8274 | −0.8894 | 5.3470 |
| 1.6292 | −0.8682 | 5.3470 |
| 1.4240 | −0.8437 | 5.3470 |
| 1.2120 | −0.8149 | 5.3470 |
| 0.9938 | −0.7795 | 5.3470 |
| 0.7767 | −0.7372 | 5.3470 |
| 0.5610 | −0.6870 | 5.3470 |
| 0.3471 | −0.6283 | 5.3470 |
| 0.1360 | −0.5617 | 5.3470 |
| −0.0724 | −0.4877 | 5.3470 |
| −0.2783 | −0.4071 | 5.3470 |
| −0.4821 | −0.3209 | 5.3470 |
| −0.6842 | −0.2302 | 5.3470 |
| −0.8849 | −0.1362 | 5.3470 |
| −1.0844 | −0.0399 | 5.3470 |
| −1.2832 | 0.0580 | 5.3470 |
| −1.4748 | 0.1537 | 5.3470 |
| −1.6592 | 0.2472 | 5.3470 |
| −1.8364 | 0.3388 | 5.3470 |
| −2.0061 | 0.4287 | 5.3470 |
| −2.1687 | 0.5163 | 5.3470 |
| −2.3243 | 0.6012 | 5.3470 |
| −2.4729 | 0.6836 | 5.3470 |
| −2.6145 | 0.7632 | 5.3470 |
| −2.7427 | 0.8367 | 5.3470 |
| −2.8573 | 0.9041 | 5.3470 |
| −2.9585 | 0.9651 | 5.3470 |
| −3.0526 | 1.0236 | 5.3470 |
| −3.1332 | 1.0758 | 5.3470 |
| −3.1930 | 1.1191 | 5.3470 |
| −3.2373 | 1.1581 | 5.3470 |
| −3.2661 | 1.1917 | 5.3470 |
| −3.2826 | 1.2206 | 5.3470 |
| −3.2875 | 1.2384 | 5.3470 |
| −3.2875 | 1.2502 | 5.3470 |
| −3.2861 | 1.2559 | 5.3470 |
| −3.2850 | 1.2587 | 5.3470 |
| −3.2638 | 1.3320 | 5.9521 |
| −3.2631 | 1.3333 | 5.9521 |
| −3.2613 | 1.3357 | 5.9521 |
| −3.2571 | 1.3398 | 5.9521 |
| −3.2468 | 1.3452 | 5.9521 |
| −3.2288 | 1.3483 | 5.9521 |
| −3.1963 | 1.3440 | 5.9521 |
| −3.1551 | 1.3298 | 5.9521 |
| −3.1008 | 1.3090 | 5.9521 |
| −3.0327 | 1.2838 | 5.9521 |
| −2.9437 | 1.2522 | 5.9521 |
| −2.8406 | 1.2172 | 5.9521 |
| −2.7301 | 1.1812 | 5.9521 |
| −2.6054 | 1.1419 | 5.9521 |
| −2.4667 | 1.0989 | 5.9521 |
| −2.3139 | 1.0520 | 5.9521 |
| −2.1542 | 1.0031 | 5.9521 |
| −1.9875 | 0.9521 | 5.9521 |
| −1.8140 | 0.8985 | 5.9521 |
| −1.6340 | 0.8416 | 5.9521 |
| −1.4477 | 0.7804 | 5.9521 |
| −1.2552 | 0.7148 | 5.9521 |
| −1.0568 | 0.6444 | 5.9521 |
| −0.8525 | 0.5690 | 5.9521 |
| −0.6493 | 0.4902 | 5.9521 |
| −0.4474 | 0.4083 | 5.9521 |
| −0.2465 | 0.3238 | 5.9521 |
| −0.0463 | 0.2377 | 5.9521 |
| 0.1537 | 0.1512 | 5.9521 |
| 0.3540 | 0.0654 | 5.9521 |
| 0.5552 | −0.0184 | 5.9521 |
| 0.7576 | −0.0992 | 5.9521 |
| 0.9614 | −0.1766 | 5.9521 |
| 1.1664 | −0.2507 | 5.9521 |
| 1.3722 | −0.3225 | 5.9521 |
| 1.5715 | −0.3908 | 5.9521 |
| 1.7640 | −0.4565 | 5.9521 |
| 1.9496 | −0.5202 | 5.9521 |
| 2.1280 | −0.5822 | 5.9521 |
| 2.2993 | −0.6425 | 5.9521 |

TABLE A-continued

| X | Y | Z |
|---|---|---|
| 2.4636 | −0.7011 | 5.9521 |
| 2.6207 | −0.7578 | 5.9521 |
| 2.7641 | −0.8101 | 5.9521 |
| 2.8937 | −0.8577 | 5.9521 |
| 3.0095 | −0.9005 | 5.9521 |
| 3.1117 | −0.9385 | 5.9521 |
| 3.2002 | −0.9714 | 5.9521 |
| 3.2750 | −0.9994 | 5.9521 |
| 3.3390 | −1.0234 | 5.9521 |
| 3.3927 | −1.0435 | 5.9521 |
| 3.4370 | −1.0601 | 5.9521 |
| 3.4723 | −1.0734 | 5.9521 |
| 3.4995 | −1.0837 | 5.9521 |
| 3.5193 | −1.0925 | 5.9521 |
| 3.5307 | −1.1062 | 5.9521 |
| 3.5345 | −1.1201 | 5.9521 |
| 3.5337 | −1.1308 | 5.9521 |
| 3.5297 | −1.1410 | 5.9521 |
| 3.5200 | −1.1520 | 5.9521 |
| 3.5032 | −1.1587 | 5.9521 |
| 3.4811 | −1.1571 | 5.9521 |
| 3.4517 | −1.1537 | 5.9521 |
| 3.4136 | −1.1492 | 5.9521 |
| 3.3659 | −1.1437 | 5.9521 |
| 3.3079 | −1.1369 | 5.9521 |
| 3.2389 | −1.1290 | 5.9521 |
| 3.1581 | −1.1196 | 5.9521 |
| 3.0627 | −1.1086 | 5.9521 |
| 2.9525 | −1.0959 | 5.9521 |
| 2.8278 | −1.0814 | 5.9521 |
| 2.6883 | −1.0650 | 5.9521 |
| 2.5342 | −1.0465 | 5.9521 |
| 2.3655 | −1.0257 | 5.9521 |
| 2.1896 | −1.0031 | 5.9521 |
| 2.0066 | −0.9785 | 5.9521 |
| 1.8165 | −0.9514 | 5.9521 |
| 1.6194 | −0.9212 | 5.9521 |
| 1.4154 | −0.8868 | 5.9521 |
| 1.2048 | −0.8470 | 5.9521 |
| 0.9879 | −0.8001 | 5.9521 |
| 0.7728 | −0.7465 | 5.9521 |
| 0.5598 | −0.6852 | 5.9521 |
| 0.3490 | −0.6161 | 5.9521 |
| 0.1407 | −0.5398 | 5.9521 |
| −0.0653 | −0.4574 | 5.9521 |
| −0.2691 | −0.3699 | 5.9521 |
| −0.4712 | −0.2783 | 5.9521 |
| −0.6718 | −0.1835 | 5.9521 |
| −0.8711 | −0.0862 | 5.9521 |
| −1.0695 | 0.0130 | 5.9521 |
| −1.2672 | 0.1135 | 5.9521 |
| −1.4578 | 0.2116 | 5.9521 |
| −1.6415 | 0.3072 | 5.9521 |
| −1.8179 | 0.4007 | 5.9521 |
| −1.9870 | 0.4922 | 5.9521 |
| −2.1490 | 0.5813 | 5.9521 |
| −2.3041 | 0.6676 | 5.9521 |
| −2.4521 | 0.7513 | 5.9521 |
| −2.5932 | 0.8323 | 5.9521 |
| −2.7209 | 0.9069 | 5.9521 |
| −2.8350 | 0.9754 | 5.9521 |
| −2.9358 | 1.0374 | 5.9521 |
| −3.0294 | 1.0968 | 5.9521 |
| −3.1097 | 1.1497 | 5.9521 |
| −3.1699 | 1.1926 | 5.9521 |
| −3.2148 | 1.2311 | 5.9521 |
| −3.2442 | 1.2641 | 5.9521 |
| −3.2614 | 1.2926 | 5.9521 |
| −3.2668 | 1.3103 | 5.9521 |
| −3.2670 | 1.3221 | 5.9521 |
| −3.2656 | 1.3279 | 5.9521 |
| −3.2645 | 1.3307 | 5.9521 |
| −3.1584 | 1.5003 | 7.5877 |
| −3.1576 | 1.5015 | 7.5877 |
| −3.1556 | 1.5037 | 7.5877 |
| −3.1508 | 1.5071 | 7.5877 |
| −3.1395 | 1.5102 | 7.5877 |
| −3.1212 | 1.5094 | 7.5877 |

TABLE A-continued

| X | Y | Z |
|---|---|---|
| −3.0900 | 1.4994 | 7.5877 |
| −3.0505 | 1.4809 | 7.5877 |
| −2.9980 | 1.4560 | 7.5877 |
| −2.9321 | 1.4254 | 7.5877 |
| −2.8458 | 1.3867 | 7.5877 |
| −2.7457 | 1.3435 | 7.5877 |
| −2.6384 | 1.2987 | 7.5877 |
| −2.5172 | 1.2495 | 7.5877 |
| −2.3820 | 1.1961 | 7.5877 |
| −2.2329 | 1.1383 | 7.5877 |
| −2.0769 | 1.0783 | 7.5877 |
| −1.9140 | 1.0160 | 7.5877 |
| −1.7443 | 0.9508 | 7.5877 |
| −1.5682 | 0.8824 | 7.5877 |
| −1.3858 | 0.8101 | 7.5877 |
| −1.1973 | 0.7333 | 7.5877 |
| −1.0031 | 0.6516 | 7.5877 |
| −0.8034 | 0.5642 | 7.5877 |
| −0.6050 | 0.4737 | 7.5877 |
| −0.4081 | 0.3802 | 7.5877 |
| −0.2125 | 0.2838 | 7.5877 |
| −0.0182 | 0.1850 | 7.5877 |
| 0.1753 | 0.0844 | 7.5877 |
| 0.3682 | −0.0174 | 7.5877 |
| 0.5609 | −0.1196 | 7.5877 |
| 0.7537 | −0.2216 | 7.5877 |
| 0.9470 | −0.3225 | 7.5877 |
| 1.1412 | −0.4218 | 7.5877 |
| 1.3365 | −0.5188 | 7.5877 |
| 1.5265 | −0.6099 | 7.5877 |
| 1.7111 | −0.6956 | 7.5877 |
| 1.8899 | −0.7766 | 7.5877 |
| 2.0626 | −0.8537 | 7.5877 |
| 2.2289 | −0.9272 | 7.5877 |
| 2.3886 | −0.9977 | 7.5877 |
| 2.5417 | −1.0652 | 7.5877 |
| 2.6813 | −1.1271 | 7.5877 |
| 2.8076 | −1.1831 | 7.5877 |
| 2.9206 | −1.2335 | 7.5877 |
| 3.0201 | −1.2781 | 7.5877 |
| 3.1063 | −1.3170 | 7.5877 |
| 3.1792 | −1.3500 | 7.5877 |
| 3.2415 | −1.3782 | 7.5877 |
| 3.2939 | −1.4018 | 7.5877 |
| 3.3370 | −1.4212 | 7.5877 |
| 3.3716 | −1.4366 | 7.5877 |
| 3.3982 | −1.4483 | 7.5877 |
| 3.4181 | −1.4572 | 7.5877 |
| 3.4314 | −1.4693 | 7.5877 |
| 3.4356 | −1.4833 | 7.5877 |
| 3.4342 | −1.4942 | 7.5877 |
| 3.4291 | −1.5038 | 7.5877 |
| 3.4175 | −1.5125 | 7.5877 |
| 3.3995 | −1.5139 | 7.5877 |
| 3.3781 | −1.5086 | 7.5877 |
| 3.3497 | −1.5015 | 7.5877 |
| 3.3126 | −1.4924 | 7.5877 |
| 3.2663 | −1.4812 | 7.5877 |
| 3.2100 | −1.4677 | 7.5877 |
| 3.1429 | −1.4519 | 7.5877 |
| 3.0644 | −1.4334 | 7.5877 |
| 2.9716 | −1.4116 | 7.5877 |
| 2.8645 | −1.3862 | 7.5877 |
| 2.7433 | −1.3573 | 7.5877 |
| 2.6078 | −1.3247 | 7.5877 |
| 2.4581 | −1.2884 | 7.5877 |
| 2.2945 | −1.2479 | 7.5877 |
| 2.1241 | −1.2045 | 7.5877 |
| 1.9473 | −1.1576 | 7.5877 |
| 1.7641 | −1.1063 | 7.5877 |
| 1.5751 | −1.0499 | 7.5877 |
| 1.3805 | −0.9871 | 7.5877 |
| 1.1807 | −0.9168 | 7.5877 |
| 0.9760 | −0.8383 | 7.5877 |
| 0.7731 | −0.7542 | 7.5877 |
| 0.5720 | −0.6651 | 7.5877 |
| 0.3723 | −0.5719 | 7.5877 |
| 0.1739 | −0.4753 | 7.5877 |

TABLE A-continued

| X | Y | Z |
|---|---|---|
| −0.0233 | −0.3762 | 7.5877 |
| −0.2196 | −0.2752 | 7.5877 |
| −0.4150 | −0.1727 | 7.5877 |
| −0.6099 | −0.0689 | 7.5877 |
| −0.8042 | 0.0357 | 7.5877 |
| −0.9981 | 0.1411 | 7.5877 |
| −1.1918 | 0.2470 | 7.5877 |
| −1.3787 | 0.3499 | 7.5877 |
| −1.5588 | 0.4498 | 7.5877 |
| −1.7321 | 0.5470 | 7.5877 |
| −1.8983 | 0.6416 | 7.5877 |
| −2.0576 | 0.7337 | 7.5877 |
| −2.2098 | 0.8232 | 7.5877 |
| −2.3550 | 0.9101 | 7.5877 |
| −2.4931 | 0.9944 | 7.5877 |
| −2.6180 | 1.0723 | 7.5877 |
| −2.7296 | 1.1436 | 7.5877 |
| −2.8281 | 1.2081 | 7.5877 |
| −2.9197 | 1.2696 | 7.5877 |
| −2.9985 | 1.3239 | 7.5877 |
| −3.0585 | 1.3663 | 7.5877 |
| −3.1046 | 1.4029 | 7.5877 |
| −3.1355 | 1.4342 | 7.5877 |
| −3.1542 | 1.4616 | 7.5877 |
| −3.1606 | 1.4787 | 7.5877 |
| −3.1615 | 1.4905 | 7.5877 |
| −3.1603 | 1.4963 | 7.5877 |
| −3.1591 | 1.4990 | 7.5877 |
| −3.1537 | 1.6836 | 9.0620 |
| −3.1528 | 1.6848 | 9.0620 |
| −3.1505 | 1.6868 | 9.0620 |
| −3.1449 | 1.6892 | 9.0620 |
| −3.1329 | 1.6898 | 9.0620 |
| −3.1146 | 1.6851 | 9.0620 |
| −3.0843 | 1.6702 | 9.0620 |
| −3.0448 | 1.6486 | 9.0620 |
| −2.9920 | 1.6200 | 9.0620 |
| −2.9257 | 1.5848 | 9.0620 |
| −2.8389 | 1.5403 | 9.0620 |
| −2.7380 | 1.4903 | 9.0620 |
| −2.6299 | 1.4381 | 9.0620 |
| −2.5077 | 1.3805 | 9.0620 |
| −2.3714 | 1.3177 | 9.0620 |
| −2.2209 | 1.2500 | 9.0620 |
| −2.0630 | 1.1804 | 9.0620 |
| −1.8981 | 1.1080 | 9.0620 |
| −1.7264 | 1.0324 | 9.0620 |
| −1.5484 | 0.9527 | 9.0620 |
| −1.3640 | 0.8686 | 9.0620 |
| −1.1737 | 0.7796 | 9.0620 |
| −0.9777 | 0.6852 | 9.0620 |
| −0.7762 | 0.5849 | 9.0620 |
| −0.5761 | 0.4818 | 9.0620 |
| −0.3775 | 0.3759 | 9.0620 |
| −0.1804 | 0.2671 | 9.0620 |
| 0.0152 | 0.1558 | 9.0620 |
| 0.2094 | 0.0423 | 9.0620 |
| 0.4025 | −0.0732 | 9.0620 |
| 0.5946 | −0.1903 | 9.0620 |
| 0.7859 | −0.3087 | 9.0620 |
| 0.9768 | −0.4278 | 9.0620 |
| 1.1676 | −0.5471 | 9.0620 |
| 1.3587 | −0.6657 | 9.0620 |
| 1.5443 | −0.7792 | 9.0620 |
| 1.7244 | −0.8871 | 9.0620 |
| 1.8991 | −0.9892 | 9.0620 |
| 2.0685 | −1.0857 | 9.0620 |
| 2.2324 | −1.1767 | 9.0620 |
| 2.3904 | −1.2629 | 9.0620 |
| 2.5424 | −1.3445 | 9.0620 |
| 2.6814 | −1.4185 | 9.0620 |
| 2.8074 | −1.4851 | 9.0620 |
| 2.9203 | −1.5445 | 9.0620 |
| 3.0198 | −1.5969 | 9.0620 |
| 3.1061 | −1.6423 | 9.0620 |
| 3.1791 | −1.6807 | 9.0620 |
| 3.2416 | −1.7133 | 9.0620 |
| 3.2943 | −1.7404 | 9.0620 |

TABLE A-continued

| X | Y | Z |
|---|---|---|
| 3.3377 | −1.7626 | 9.0620 |
| 3.3725 | −1.7802 | 9.0620 |
| 3.3993 | −1.7937 | 9.0620 |
| 3.4195 | −1.8038 | 9.0620 |
| 3.4347 | −1.8142 | 9.0620 |
| 3.4399 | −1.8278 | 9.0620 |
| 3.4383 | −1.8388 | 9.0620 |
| 3.4320 | −1.8481 | 9.0620 |
| 3.4184 | −1.8542 | 9.0620 |
| 3.4000 | −1.8503 | 9.0620 |
| 3.3786 | −1.8432 | 9.0620 |
| 3.3500 | −1.8337 | 9.0620 |
| 3.3127 | −1.8214 | 9.0620 |
| 3.2662 | −1.8062 | 9.0620 |
| 3.2095 | −1.7877 | 9.0620 |
| 3.1421 | −1.7659 | 9.0620 |
| 3.0632 | −1.7404 | 9.0620 |
| 2.9700 | −1.7099 | 9.0620 |
| 2.8627 | −1.6742 | 9.0620 |
| 2.7413 | −1.6332 | 9.0620 |
| 2.6059 | −1.5867 | 9.0620 |
| 2.4566 | −1.5343 | 9.0620 |
| 2.2937 | −1.4755 | 9.0620 |
| 2.1245 | −1.4119 | 9.0620 |
| 1.9495 | −1.3428 | 9.0620 |
| 1.7689 | −1.2675 | 9.0620 |
| 1.5830 | −1.1852 | 9.0620 |
| 1.3919 | −1.0956 | 9.0620 |
| 1.1957 | −0.9988 | 9.0620 |
| 0.9945 | −0.8949 | 9.0620 |
| 0.7949 | −0.7880 | 9.0620 |
| 0.5967 | −0.6788 | 9.0620 |
| 0.3993 | −0.5680 | 9.0620 |
| 0.2025 | −0.4561 | 9.0620 |
| 0.0061 | −0.3435 | 9.0620 |
| −0.1900 | −0.2304 | 9.0620 |
| −0.3857 | −0.1167 | 9.0620 |
| −0.5812 | −0.0024 | 9.0620 |
| −0.7763 | 0.1123 | 9.0620 |
| −0.9712 | 0.2275 | 9.0620 |
| −1.1659 | 0.3431 | 9.0620 |
| −1.3538 | 0.4552 | 9.0620 |
| −1.5349 | 0.5640 | 9.0620 |
| −1.7092 | 0.6695 | 9.0620 |
| −1.8767 | 0.7718 | 9.0620 |
| −2.0372 | 0.8708 | 9.0620 |
| −2.1907 | 0.9670 | 9.0620 |
| −2.3370 | 1.0604 | 9.0620 |
| −2.4758 | 1.1514 | 9.0620 |
| −2.6011 | 1.2355 | 9.0620 |
| −2.7131 | 1.3124 | 9.0620 |
| −2.8120 | 1.3817 | 9.0620 |
| −2.9039 | 1.4477 | 9.0620 |
| −2.9830 | 1.5057 | 9.0620 |
| −3.0434 | 1.5510 | 9.0620 |
| −3.0912 | 1.5879 | 9.0620 |
| −3.1247 | 1.6183 | 9.0620 |
| −3.1459 | 1.6447 | 9.0620 |
| −3.1542 | 1.6616 | 9.0620 |
| −3.1565 | 1.6734 | 9.0620 |
| −3.1557 | 1.6794 | 9.0620 |
| −3.1545 | 1.6822 | 9.0620 |
| −3.1672 | 1.8795 | 10.6014 |
| −3.1661 | 1.8807 | 10.6014 |
| −3.1634 | 1.8823 | 10.6014 |
| −3.1572 | 1.8835 | 10.6014 |
| −3.1449 | 1.8814 | 10.6014 |
| −3.1273 | 1.8732 | 10.6014 |
| −3.0976 | 1.8549 | 10.6014 |
| −3.0580 | 1.8304 | 10.6014 |
| −3.0049 | 1.7984 | 10.6014 |
| −2.9381 | 1.7591 | 10.6014 |
| −2.8506 | 1.7090 | 10.6014 |
| −2.7490 | 1.6525 | 10.6014 |
| −2.6400 | 1.5933 | 10.6014 |
| −2.5169 | 1.5276 | 10.6014 |
| −2.3796 | 1.4557 | 10.6014 |
| −2.2280 | 1.3776 | 10.6014 |

TABLE A-continued

| X | Y | Z |
|---|---|---|
| −2.0693 | 1.2965 | 10.6014 |
| −1.9036 | 1.2119 | 10.6014 |
| −1.7312 | 1.1235 | 10.6014 |
| −1.5522 | 1.0308 | 10.6014 |
| −1.3672 | 0.9332 | 10.6014 |
| −1.1762 | 0.8301 | 10.6014 |
| −0.9797 | 0.7212 | 10.6014 |
| −0.7777 | 0.6061 | 10.6014 |
| −0.5770 | 0.4884 | 10.6014 |
| −0.3778 | 0.3683 | 10.6014 |
| −0.1801 | 0.2458 | 10.6014 |
| 0.0161 | 0.1210 | 10.6014 |
| 0.2108 | −0.0059 | 10.6014 |
| 0.4043 | −0.1348 | 10.6014 |
| 0.5965 | −0.2656 | 10.6014 |
| 0.7877 | −0.3980 | 10.6014 |
| 0.9781 | −0.5316 | 10.6014 |
| 1.1681 | −0.6657 | 10.6014 |
| 1.3581 | −0.7999 | 10.6014 |
| 1.5421 | −0.9290 | 10.6014 |
| 1.7205 | −1.0527 | 10.6014 |
| 1.8934 | −1.1706 | 10.6014 |
| 2.0610 | −1.2827 | 10.6014 |
| 2.2231 | −1.3890 | 10.6014 |
| 2.3798 | −1.4893 | 10.6014 |
| 2.5310 | −1.5841 | 10.6014 |
| 2.6697 | −1.6694 | 10.6014 |
| 2.7957 | −1.7456 | 10.6014 |
| 2.9090 | −1.8131 | 10.6014 |
| 3.0093 | −1.8720 | 10.6014 |
| 3.0965 | −1.9227 | 10.6014 |
| 3.1704 | −1.9652 | 10.6014 |
| 3.2337 | −2.0014 | 10.6014 |
| 3.2869 | −2.0317 | 10.6014 |
| 3.3307 | −2.0566 | 10.6014 |
| 3.3658 | −2.0766 | 10.6014 |
| 3.3927 | −2.0919 | 10.6014 |
| 3.4129 | −2.1034 | 10.6014 |
| 3.4295 | −2.1134 | 10.6014 |
| 3.4365 | −2.1269 | 10.6014 |
| 3.4348 | −2.1384 | 10.6014 |
| 3.4273 | −2.1472 | 10.6014 |
| 3.4124 | −2.1503 | 10.6014 |
| 3.3941 | −2.1436 | 10.6014 |
| 3.3724 | −2.1351 | 10.6014 |
| 3.3434 | −2.1237 | 10.6014 |
| 3.3058 | −2.1088 | 10.6014 |
| 3.2588 | −2.0900 | 10.6014 |
| 3.2018 | −2.0670 | 10.6014 |
| 3.1342 | −2.0393 | 10.6014 |
| 3.0551 | −2.0065 | 10.6014 |
| 2.9619 | −1.9673 | 10.6014 |
| 2.8545 | −1.9216 | 10.6014 |
| 2.7333 | −1.8690 | 10.6014 |
| 2.5984 | −1.8088 | 10.6014 |
| 2.4502 | −1.7406 | 10.6014 |
| 2.2890 | −1.6636 | 10.6014 |
| 2.1221 | −1.5806 | 10.6014 |
| 1.9496 | −1.4914 | 10.6014 |
| 1.7717 | −1.3956 | 10.6014 |
| 1.5886 | −1.2929 | 10.6014 |
| 1.4002 | −1.1835 | 10.6014 |
| 1.2068 | −1.0675 | 10.6014 |
| 1.0081 | −0.9451 | 10.6014 |
| 0.8107 | −0.8209 | 10.6014 |
| 0.6139 | −0.6955 | 10.6014 |
| 0.4176 | −0.5694 | 10.6014 |
| 0.2215 | −0.4431 | 10.6014 |
| 0.0253 | −0.3168 | 10.6014 |
| −0.1708 | −0.1905 | 10.6014 |
| −0.3669 | −0.0640 | 10.6014 |
| −0.5628 | 0.0626 | 10.6014 |
| −0.7586 | 0.1895 | 10.6014 |
| −0.9542 | 0.3167 | 10.6014 |
| −1.1496 | 0.4441 | 10.6014 |
| −1.3385 | 0.5674 | 10.6014 |
| −1.5208 | 0.6865 | 10.6014 |
| −1.6964 | 0.8016 | 10.6014 |

TABLE A-continued

| X | Y | Z |
|---|---|---|
| −1.8653 | 0.9128 | 10.6014 |
| −2.0272 | 1.0204 | 10.6014 |
| −2.1821 | 1.1246 | 10.6014 |
| −2.3300 | 1.2251 | 10.6014 |
| −2.4707 | 1.3225 | 10.6014 |
| −2.5977 | 1.4122 | 10.6014 |
| −2.7114 | 1.4939 | 10.6014 |
| −2.8118 | 1.5674 | 10.6014 |
| −2.9051 | 1.6373 | 10.6014 |
| −2.9855 | 1.6987 | 10.6014 |
| −3.0468 | 1.7466 | 10.6014 |
| −3.0955 | 1.7853 | 10.6014 |
| −3.1312 | 1.8153 | 10.6014 |
| −3.1551 | 1.8407 | 10.6014 |
| −3.1654 | 1.8572 | 10.6014 |
| −3.1692 | 1.8690 | 10.6014 |
| −3.1690 | 1.8752 | 10.6014 |
| −3.1680 | 1.8782 | 10.6014 |
| −3.0639 | 2.0638 | 12.7118 |
| −3.0627 | 2.0648 | 12.7118 |
| −3.0598 | 2.0660 | 12.7118 |
| −3.0535 | 2.0658 | 12.7118 |
| −3.0417 | 2.0615 | 12.7118 |
| −3.0253 | 2.0510 | 12.7118 |
| −2.9969 | 2.0304 | 12.7118 |
| −2.9588 | 2.0032 | 12.7118 |
| −2.9075 | 1.9677 | 12.7118 |
| −2.8430 | 1.9239 | 12.7118 |
| −2.7585 | 1.8679 | 12.7118 |
| −2.6603 | 1.8045 | 12.7118 |
| −2.5548 | 1.7379 | 12.7118 |
| −2.4357 | 1.6638 | 12.7118 |
| −2.3028 | 1.5822 | 12.7118 |
| −2.1563 | 1.4931 | 12.7118 |
| −2.0029 | 1.4002 | 12.7118 |
| −1.8429 | 1.3032 | 12.7118 |
| −1.6766 | 1.2016 | 12.7118 |
| −1.5039 | 1.0954 | 12.7118 |
| −1.3253 | 0.9841 | 12.7118 |
| −1.1407 | 0.8675 | 12.7118 |
| −0.9505 | 0.7454 | 12.7118 |
| −0.7549 | 0.6172 | 12.7118 |
| −0.5606 | 0.4872 | 12.7118 |
| −0.3675 | 0.3551 | 12.7118 |
| −0.1757 | 0.2212 | 12.7118 |
| 0.0147 | 0.0855 | 12.7118 |
| 0.2039 | −0.0519 | 12.7118 |
| 0.3920 | −0.1907 | 12.7118 |
| 0.5792 | −0.3310 | 12.7118 |
| 0.7654 | −0.4724 | 12.7118 |
| 0.9509 | −0.6149 | 12.7118 |
| 1.1356 | −0.7583 | 12.7118 |
| 1.3198 | −0.9024 | 12.7118 |
| 1.4974 | −1.0423 | 12.7118 |
| 1.6693 | −1.1769 | 12.7118 |
| 1.8356 | −1.3059 | 12.7118 |
| 1.9963 | −1.4294 | 12.7118 |
| 2.1517 | −1.5470 | 12.7118 |
| 2.3022 | −1.6581 | 12.7118 |
| 2.4476 | −1.7631 | 12.7118 |
| 2.5812 | −1.8576 | 12.7118 |
| 2.7029 | −1.9421 | 12.7118 |
| 2.8124 | −2.0168 | 12.7118 |
| 2.9094 | −2.0820 | 12.7118 |
| 2.9938 | −2.1382 | 12.7118 |
| 3.0654 | −2.1855 | 12.7118 |
| 3.1266 | −2.2257 | 12.7118 |
| 3.1781 | −2.2595 | 12.7118 |
| 3.2205 | −2.2872 | 12.7118 |
| 3.2545 | −2.3094 | 12.7118 |
| 3.2806 | −2.3265 | 12.7118 |
| 3.3001 | −2.3393 | 12.7118 |
| 3.3164 | −2.3499 | 12.7118 |
| 3.3253 | −2.3623 | 12.7118 |
| 3.3236 | −2.3738 | 12.7118 |
| 3.3150 | −2.3817 | 12.7118 |
| 3.2998 | −2.3806 | 12.7118 |
| 3.2821 | −2.3723 | 12.7118 |

TABLE A-continued

| X | Y | Z |
|---|---|---|
| 3.2608 | −2.3623 | 12.7118 |
| 3.2325 | −2.3489 | 12.7118 |
| 3.1958 | −2.3314 | 12.7118 |
| 3.1499 | −2.3093 | 12.7118 |
| 3.0943 | −2.2823 | 12.7118 |
| 3.0283 | −2.2498 | 12.7118 |
| 2.9514 | −2.2111 | 12.7118 |
| 2.8608 | −2.1648 | 12.7118 |
| 2.7567 | −2.1107 | 12.7118 |
| 2.6393 | −2.0480 | 12.7118 |
| 2.5092 | −1.9764 | 12.7118 |
| 2.3667 | −1.8951 | 12.7118 |
| 2.2123 | −1.8035 | 12.7118 |
| 2.0528 | −1.7053 | 12.7118 |
| 1.8882 | −1.6007 | 12.7118 |
| 1.7185 | −1.4894 | 12.7118 |
| 1.5440 | −1.3712 | 12.7118 |
| 1.3642 | −1.2468 | 12.7118 |
| 1.1787 | −1.1168 | 12.7118 |
| 0.9874 | −0.9813 | 12.7118 |
| 0.7967 | −0.8451 | 12.7118 |
| 0.6062 | −0.7086 | 12.7118 |
| 0.4158 | −0.5718 | 12.7118 |
| 0.2257 | −0.4347 | 12.7118 |
| 0.0358 | −0.2973 | 12.7118 |
| −0.1540 | −0.1598 | 12.7118 |
| −0.3437 | −0.0221 | 12.7118 |
| −0.5332 | 0.1157 | 12.7118 |
| −0.7227 | 0.2537 | 12.7118 |
| −0.9122 | 0.3917 | 12.7118 |
| −1.1015 | 0.5299 | 12.7118 |
| −1.2845 | 0.6635 | 12.7118 |
| −1.4609 | 0.7928 | 12.7118 |
| −1.6308 | 0.9178 | 12.7118 |
| −1.7942 | 1.0386 | 12.7118 |
| −1.9509 | 1.1551 | 12.7118 |
| −2.1011 | 1.2675 | 12.7118 |
| −2.2446 | 1.3755 | 12.7118 |
| −2.3813 | 1.4797 | 12.7118 |
| −2.5049 | 1.5754 | 12.7118 |
| −2.6156 | 1.6621 | 12.7118 |
| −2.7134 | 1.7399 | 12.7118 |
| −2.8044 | 1.8138 | 12.7118 |
| −2.8825 | 1.8787 | 12.7118 |
| −2.9420 | 1.9293 | 12.7118 |
| −2.9893 | 1.9702 | 12.7118 |
| −3.0246 | 2.0010 | 12.7118 |
| −3.0495 | 2.0258 | 12.7118 |
| −3.0608 | 2.0417 | 12.7118 |
| −3.0654 | 2.0533 | 12.7118 |
| −3.0657 | 2.0595 | 12.7118 |
| −3.0648 | 2.0625 | 12.7118 |
| −3.0158 | 2.1443 | 13.4430 |
| −3.0146 | 2.1453 | 13.4430 |
| −3.0116 | 2.1463 | 13.4430 |
| −3.0053 | 2.1459 | 13.4430 |
| −2.9936 | 2.1412 | 13.4430 |
| −2.9774 | 2.1302 | 13.4430 |
| −2.9493 | 2.1090 | 13.4430 |
| −2.9116 | 2.0809 | 13.4430 |
| −2.8610 | 2.0441 | 13.4430 |
| −2.7972 | 1.9986 | 13.4430 |
| −2.7138 | 1.9404 | 13.4430 |
| −2.6169 | 1.8741 | 13.4430 |
| −2.5129 | 1.8043 | 13.4430 |
| −2.3956 | 1.7263 | 13.4430 |
| −2.2649 | 1.6401 | 13.4430 |
| −2.1208 | 1.5459 | 13.4430 |
| −1.9700 | 1.4475 | 13.4430 |
| −1.8127 | 1.3447 | 13.4430 |
| −1.6492 | 1.2373 | 13.4430 |
| −1.4795 | 1.1249 | 13.4430 |
| −1.3038 | 1.0074 | 13.4430 |
| −1.1221 | 0.8848 | 13.4430 |
| −0.9347 | 0.7568 | 13.4430 |
| −0.7415 | 0.6233 | 13.4430 |
| −0.5491 | 0.4887 | 13.4430 |
| −0.3576 | 0.3528 | 13.4430 |

TABLE A-continued

| X | Y | Z |
|---|---|---|
| −0.1671 | 0.2155 | 13.4430 |
| 0.0222 | 0.0767 | 13.4430 |
| 0.2104 | −0.0636 | 13.4430 |
| 0.3975 | −0.2055 | 13.4430 |
| 0.5836 | −0.3486 | 13.4430 |
| 0.7688 | −0.4930 | 13.4430 |
| 0.9531 | −0.6384 | 13.4430 |
| 1.1367 | −0.7848 | 13.4430 |
| 1.3196 | −0.9321 | 13.4430 |
| 1.4958 | −1.0752 | 13.4430 |
| 1.6659 | −1.2134 | 13.4430 |
| 1.8302 | −1.3464 | 13.4430 |
| 1.9884 | −1.4743 | 13.4430 |
| 2.1410 | −1.5968 | 13.4430 |
| 2.2884 | −1.7133 | 13.4430 |
| 2.4306 | −1.8236 | 13.4430 |
| 2.5615 | −1.9231 | 13.4430 |
| 2.6808 | −2.0120 | 13.4430 |
| 2.7881 | −2.0906 | 13.4430 |
| 2.8832 | −2.1594 | 13.4430 |
| 2.9660 | −2.2187 | 13.4430 |
| 3.0361 | −2.2687 | 13.4430 |
| 3.0962 | −2.3112 | 13.4430 |
| 3.1467 | −2.3468 | 13.4430 |
| 3.1884 | −2.3760 | 13.4430 |
| 3.2217 | −2.3994 | 13.4430 |
| 3.2474 | −2.4173 | 13.4430 |
| 3.2666 | −2.4308 | 13.4430 |
| 3.2827 | −2.4420 | 13.4430 |
| 3.2921 | −2.4540 | 13.4430 |
| 3.2905 | −2.4655 | 13.4430 |
| 3.2815 | −2.4730 | 13.4430 |
| 3.2664 | −2.4702 | 13.4430 |
| 3.2488 | −2.4615 | 13.4430 |
| 3.2277 | −2.4510 | 13.4430 |
| 3.1996 | −2.4369 | 13.4430 |
| 3.1631 | −2.4185 | 13.4430 |
| 3.1176 | −2.3953 | 13.4430 |
| 3.0624 | −2.3670 | 13.4430 |
| 2.9969 | −2.3328 | 13.4430 |
| 2.9207 | −2.2922 | 13.4430 |
| 2.8309 | −2.2434 | 13.4430 |
| 2.7280 | −2.1861 | 13.4430 |
| 2.6123 | −2.1196 | 13.4430 |
| 2.4843 | −2.0434 | 13.4430 |
| 2.3444 | −1.9567 | 13.4430 |
| 2.1928 | −1.8592 | 13.4430 |
| 2.0363 | −1.7549 | 13.4430 |
| 1.8747 | −1.6442 | 13.4430 |
| 1.7078 | −1.5272 | 13.4430 |
| 1.5356 | −1.4039 | 13.4430 |
| 1.3577 | −1.2750 | 13.4430 |
| 1.1739 | −1.1410 | 13.4430 |
| 0.9843 | −1.0016 | 13.4430 |
| 0.7949 | −0.8619 | 13.4430 |
| 0.6058 | −0.7219 | 13.4430 |
| 0.4167 | −0.5817 | 13.4430 |
| 0.2279 | −0.4413 | 13.4430 |
| 0.0392 | −0.3006 | 13.4430 |
| −0.1492 | −0.1596 | 13.4430 |
| −0.3375 | −0.0184 | 13.4430 |
| −0.5254 | 0.1233 | 13.4430 |
| −0.7129 | 0.2654 | 13.4430 |
| −0.9000 | 0.4082 | 13.4430 |
| −1.0866 | 0.5516 | 13.4430 |
| −1.2665 | 0.6909 | 13.4430 |
| −1.4397 | 0.8259 | 13.4430 |
| −1.6064 | 0.9565 | 13.4430 |
| −1.7667 | 1.0827 | 13.4430 |
| −1.9205 | 1.2044 | 13.4430 |
| −2.0677 | 1.3217 | 13.4430 |
| −2.2086 | 1.4345 | 13.4430 |
| −2.3428 | 1.5430 | 13.4430 |
| −2.4642 | 1.6423 | 13.4430 |
| −2.5731 | 1.7322 | 13.4430 |
| −2.6694 | 1.8127 | 13.4430 |
| −2.7591 | 1.8889 | 13.4430 |
| −2.8362 | 1.9557 | 13.4430 |

TABLE A-continued

| X | Y | Z |
|---|---|---|
| −2.8950 | 2.0076 | 13.4430 |
| −2.9418 | 2.0494 | 13.4430 |
| −2.9767 | 2.0809 | 13.4430 |
| −3.0015 | 2.1060 | 13.4430 |
| −3.0127 | 2.1221 | 13.4430 |
| −3.0173 | 2.1337 | 13.4430 |
| −3.0176 | 2.1399 | 13.4430 |
| −3.0167 | 2.1429 | 13.4430 |
| −2.9601 | 2.3369 | 15.0640 |
| −2.9588 | 2.3379 | 15.0640 |
| −2.9556 | 2.3387 | 15.0640 |
| −2.9492 | 2.3378 | 15.0640 |
| −2.9376 | 2.3324 | 15.0640 |
| −2.9214 | 2.3207 | 15.0640 |
| −2.8935 | 2.2981 | 15.0640 |
| −2.8561 | 2.2682 | 15.0640 |
| −2.8060 | 2.2285 | 15.0640 |
| −2.7429 | 2.1796 | 15.0640 |
| −2.6602 | 2.1169 | 15.0640 |
| −2.5639 | 2.0458 | 15.0640 |
| −2.4605 | 1.9709 | 15.0640 |
| −2.3437 | 1.8872 | 15.0640 |
| −2.2134 | 1.7949 | 15.0640 |
| −2.0698 | 1.6939 | 15.0640 |
| −1.9195 | 1.5884 | 15.0640 |
| −1.7628 | 1.4782 | 15.0640 |
| −1.5998 | 1.3629 | 15.0640 |
| −1.4309 | 1.2424 | 15.0640 |
| −1.2560 | 1.1164 | 15.0640 |
| −1.0755 | 0.9846 | 15.0640 |
| −0.8895 | 0.8467 | 15.0640 |
| −0.6983 | 0.7026 | 15.0640 |
| −0.5083 | 0.5569 | 15.0640 |
| −0.3196 | 0.4095 | 15.0640 |
| −0.1322 | 0.2604 | 15.0640 |
| 0.0539 | 0.1097 | 15.0640 |
| 0.2387 | −0.0425 | 15.0640 |
| 0.4224 | −0.1962 | 15.0640 |
| 0.6049 | −0.3511 | 15.0640 |
| 0.7864 | −0.5073 | 15.0640 |
| 0.9668 | −0.6649 | 15.0640 |
| 1.1462 | −0.8235 | 15.0640 |
| 1.3249 | −0.9829 | 15.0640 |
| 1.4971 | −1.1376 | 15.0640 |
| 1.6633 | −1.2871 | 15.0640 |
| 1.8236 | −1.4312 | 15.0640 |
| 1.9780 | −1.5698 | 15.0640 |
| 2.1270 | −1.7027 | 15.0640 |
| 2.2706 | −1.8294 | 15.0640 |
| 2.4092 | −1.9499 | 15.0640 |
| 2.5367 | −2.0588 | 15.0640 |
| 2.6527 | −2.1565 | 15.0640 |
| 2.7572 | −2.2431 | 15.0640 |
| 2.8498 | −2.3190 | 15.0640 |
| 2.9303 | −2.3845 | 15.0640 |
| 2.9986 | −2.4397 | 15.0640 |
| 3.0571 | −2.4868 | 15.0640 |
| 3.1063 | −2.5262 | 15.0640 |
| 3.1469 | −2.5585 | 15.0640 |
| 3.1793 | −2.5844 | 15.0640 |
| 3.2043 | −2.6043 | 15.0640 |
| 3.2231 | −2.6192 | 15.0640 |
| 3.2387 | −2.6316 | 15.0640 |
| 3.2487 | −2.6437 | 15.0640 |
| 3.2470 | −2.6554 | 15.0640 |
| 3.2372 | −2.6621 | 15.0640 |
| 3.2221 | −2.6577 | 15.0640 |
| 3.2043 | −2.6483 | 15.0640 |
| 3.1831 | −2.6371 | 15.0640 |
| 3.1548 | −2.6220 | 15.0640 |
| 3.1181 | −2.6022 | 15.0640 |
| 3.0724 | −2.5774 | 15.0640 |
| 3.0169 | −2.5469 | 15.0640 |
| 2.9513 | −2.5099 | 15.0640 |
| 2.8750 | −2.4658 | 15.0640 |
| 2.7853 | −2.4127 | 15.0640 |
| 2.6827 | −2.3504 | 15.0640 |
| 2.5675 | −2.2780 | 15.0640 |

TABLE A-continued

| X | Y | Z |
|---|---|---|
| 2.4404 | −2.1949 | 15.0640 |
| 2.3018 | −2.1005 | 15.0640 |
| 2.1520 | −1.9942 | 15.0640 |
| 1.9977 | −1.8803 | 15.0640 |
| 1.8390 | −1.7591 | 15.0640 |
| 1.6756 | −1.6306 | 15.0640 |
| 1.5073 | −1.4953 | 15.0640 |
| 1.3335 | −1.3539 | 15.0640 |
| 1.1540 | −1.2071 | 15.0640 |
| 0.9682 | −1.0551 | 15.0640 |
| 0.7824 | −0.9032 | 15.0640 |
| 0.5966 | −0.7513 | 15.0640 |
| 0.4110 | −0.5992 | 15.0640 |
| 0.2256 | −0.4467 | 15.0640 |
| 0.0406 | −0.2939 | 15.0640 |
| −0.1441 | −0.1406 | 15.0640 |
| −0.3284 | 0.0131 | 15.0640 |
| −0.5124 | 0.1672 | 15.0640 |
| −0.6961 | 0.3216 | 15.0640 |
| −0.8796 | 0.4762 | 15.0640 |
| −1.0630 | 0.6310 | 15.0640 |
| −1.2401 | 0.7809 | 15.0640 |
| −1.4107 | 0.9260 | 15.0640 |
| −1.5750 | 1.0663 | 15.0640 |
| −1.7329 | 1.2017 | 15.0640 |
| −1.8844 | 1.3323 | 15.0640 |
| −2.0295 | 1.4580 | 15.0640 |
| −2.1683 | 1.5787 | 15.0640 |
| −2.3005 | 1.6949 | 15.0640 |
| −2.4201 | 1.8012 | 15.0640 |
| −2.5272 | 1.8975 | 15.0640 |
| −2.6218 | 1.9837 | 15.0640 |
| −2.7097 | 2.0653 | 15.0640 |
| −2.7852 | 2.1368 | 15.0640 |
| −2.8429 | 2.1922 | 15.0640 |
| −2.8888 | 2.2369 | 15.0640 |
| −2.9229 | 2.2707 | 15.0640 |
| −2.9470 | 2.2974 | 15.0640 |
| −2.9578 | 2.3141 | 15.0640 |
| −2.9620 | 2.3262 | 15.0640 |
| −2.9621 | 2.3326 | 15.0640 |
| −2.9610 | 2.3356 | 15.0640 |
| −2.9426 | 2.4170 | 15.6890 |
| −2.9413 | 2.4180 | 15.6890 |
| −2.9381 | 2.4187 | 15.6890 |
| −2.9317 | 2.4177 | 15.6890 |
| −2.9200 | 2.4121 | 15.6890 |
| −2.9038 | 2.4001 | 15.6890 |
| −2.8759 | 2.3768 | 15.6890 |
| −2.8386 | 2.3459 | 15.6890 |
| −2.7886 | 2.3051 | 15.6890 |
| −2.7256 | 2.2546 | 15.6890 |
| −2.6429 | 2.1901 | 15.6890 |
| −2.5465 | 2.1167 | 15.6890 |
| −2.4431 | 2.0394 | 15.6890 |
| −2.3262 | 1.9532 | 15.6890 |
| −2.1959 | 1.8579 | 15.6890 |
| −2.0522 | 1.7537 | 15.6890 |
| −1.9018 | 1.6448 | 15.6890 |
| −1.7450 | 1.5311 | 15.6890 |
| −1.5818 | 1.4124 | 15.6890 |
| −1.4126 | 1.2883 | 15.6890 |
| −1.2375 | 1.1586 | 15.6890 |
| −1.0569 | 1.0228 | 15.6890 |
| −0.8709 | 0.8807 | 15.6890 |
| −0.6797 | 0.7322 | 15.6890 |
| −0.4897 | 0.5822 | 15.6890 |
| −0.3010 | 0.4305 | 15.6890 |
| −0.1136 | 0.2772 | 15.6890 |
| 0.0724 | 0.1223 | 15.6890 |
| 0.2570 | −0.0342 | 15.6890 |
| 0.4403 | −0.1923 | 15.6890 |
| 0.6224 | −0.3518 | 15.6890 |
| 0.8032 | −0.5128 | 15.6890 |
| 0.9828 | −0.6752 | 15.6890 |
| 1.1615 | −0.8385 | 15.6890 |
| 1.3395 | −1.0026 | 15.6890 |
| 1.5113 | −1.1616 | 15.6890 |

TABLE A-continued

| X | Y | Z |
|---|---|---|
| 1.6770 | −1.3153 | 15.6890 |
| 1.8368 | −1.4634 | 15.6890 |
| 1.9907 | −1.6060 | 15.6890 |
| 2.1388 | −1.7431 | 15.6890 |
| 2.2815 | −1.8741 | 15.6890 |
| 2.4189 | −1.9988 | 15.6890 |
| 2.5452 | −2.1119 | 15.6890 |
| 2.6600 | −2.2135 | 15.6890 |
| 2.7634 | −2.3038 | 15.6890 |
| 2.8551 | −2.3828 | 15.6890 |
| 2.9349 | −2.4509 | 15.6890 |
| 3.0026 | −2.5084 | 15.6890 |
| 3.0605 | −2.5574 | 15.6890 |
| 3.1093 | −2.5984 | 15.6890 |
| 3.1495 | −2.6321 | 15.6890 |
| 3.1817 | −2.6590 | 15.6890 |
| 3.2065 | −2.6797 | 15.6890 |
| 3.2251 | −2.6953 | 15.6890 |
| 3.2406 | −2.7082 | 15.6890 |
| 3.2504 | −2.7204 | 15.6890 |
| 3.2485 | −2.7320 | 15.6890 |
| 3.2385 | −2.7386 | 15.6890 |
| 3.2233 | −2.7339 | 15.6890 |
| 3.2054 | −2.7244 | 15.6890 |
| 3.1840 | −2.7129 | 15.6890 |
| 3.1555 | −2.6976 | 15.6890 |
| 3.1185 | −2.6774 | 15.6890 |
| 3.0724 | −2.6521 | 15.6890 |
| 3.0165 | −2.6210 | 15.6890 |
| 2.9504 | −2.5831 | 15.6890 |
| 2.8737 | −2.5378 | 15.6890 |
| 2.7838 | −2.4832 | 15.6890 |
| 2.6809 | −2.4190 | 15.6890 |
| 2.5655 | −2.3443 | 15.6890 |
| 2.4381 | −2.2586 | 15.6890 |
| 2.2991 | −2.1611 | 15.6890 |
| 2.1490 | −2.0513 | 15.6890 |
| 1.9944 | −1.9337 | 15.6890 |
| 1.8352 | −1.8087 | 15.6890 |
| 1.6716 | −1.6766 | 15.6890 |
| 1.5032 | −1.5376 | 15.6890 |
| 1.3296 | −1.3922 | 15.6890 |
| 1.1503 | −1.2410 | 15.6890 |
| 0.9651 | −1.0843 | 15.6890 |
| 0.7800 | −0.9275 | 15.6890 |
| 0.5949 | −0.7707 | 15.6890 |
| 0.4100 | −0.6136 | 15.6890 |
| 0.2254 | −0.4563 | 15.6890 |
| 0.0410 | −0.2987 | 15.6890 |
| −0.1431 | −0.1406 | 15.6890 |
| −0.3268 | 0.0178 | 15.6890 |
| −0.5102 | 0.1767 | 15.6890 |
| −0.6932 | 0.3360 | 15.6890 |
| −0.8758 | 0.4957 | 15.6890 |
| −1.0583 | 0.6556 | 15.6890 |
| −1.2345 | 0.8105 | 15.6890 |
| −1.4043 | 0.9603 | 15.6890 |
| −1.5677 | 1.1052 | 15.6890 |
| −1.7247 | 1.2451 | 15.6890 |
| −1.8753 | 1.3800 | 15.6890 |
| −2.0194 | 1.5100 | 15.6890 |
| −2.1573 | 1.6349 | 15.6890 |
| −2.2886 | 1.7550 | 15.6890 |
| −2.4073 | 1.8649 | 15.6890 |
| −2.5136 | 1.9643 | 15.6890 |
| −2.6076 | 2.0533 | 15.6890 |
| −2.6949 | 2.1375 | 15.6890 |
| −2.7698 | 2.2113 | 15.6890 |
| −2.8271 | 2.2684 | 15.6890 |
| −2.8725 | 2.3145 | 15.6890 |
| −2.9063 | 2.3493 | 15.6890 |
| −2.9302 | 2.3767 | 15.6890 |
| −2.9407 | 2.3939 | 15.6890 |
| −2.9447 | 2.4062 | 15.6890 |
| −2.9447 | 2.4126 | 15.6890 |
| −2.9436 | 2.4157 | 15.6890 |
| −2.9337 | 2.4848 | 16.1940 |
| −2.9323 | 2.4858 | 16.1940 |

TABLE A-continued

| X | Y | Z |
|---|---|---|
| −2.9291 | 2.4866 | 16.1940 |
| −2.9226 | 2.4855 | 16.1940 |
| −2.9109 | 2.4797 | 16.1940 |
| −2.8946 | 2.4675 | 16.1940 |
| −2.8668 | 2.4436 | 16.1940 |
| −2.8295 | 2.4119 | 16.1940 |
| −2.7794 | 2.3701 | 16.1940 |
| −2.7163 | 2.3184 | 16.1940 |
| −2.6336 | 2.2522 | 16.1940 |
| −2.5373 | 2.1769 | 16.1940 |
| −2.4338 | 2.0975 | 16.1940 |
| −2.3168 | 2.0090 | 16.1940 |
| −2.1862 | 1.9115 | 16.1940 |
| −2.0419 | 1.8050 | 16.1940 |
| −1.8909 | 1.6938 | 16.1940 |
| −1.7335 | 1.5777 | 16.1940 |
| −1.5697 | 1.4564 | 16.1940 |
| −1.3998 | 1.3297 | 16.1940 |
| −1.2242 | 1.1970 | 16.1940 |
| −1.0432 | 1.0580 | 16.1940 |
| −0.8569 | 0.9125 | 16.1940 |
| −0.6655 | 0.7603 | 16.1940 |
| −0.4755 | 0.6065 | 16.1940 |
| −0.2867 | 0.4510 | 16.1940 |
| −0.0994 | 0.2938 | 16.1940 |
| 0.0865 | 0.1350 | 16.1940 |
| 0.2709 | −0.0254 | 16.1940 |
| 0.4538 | −0.1876 | 16.1940 |
| 0.6355 | −0.3512 | 16.1940 |
| 0.8160 | −0.5161 | 16.1940 |
| 0.9952 | −0.6824 | 16.1940 |
| 1.1737 | −0.8496 | 16.1940 |
| 1.3517 | −1.0173 | 16.1940 |
| 1.5234 | −1.1797 | 16.1940 |
| 1.6891 | −1.3367 | 16.1940 |
| 1.8488 | −1.4882 | 16.1940 |
| 2.0021 | −1.6345 | 16.1940 |
| 2.1494 | −1.7753 | 16.1940 |
| 2.2911 | −1.9102 | 16.1940 |
| 2.4275 | −2.0388 | 16.1940 |
| 2.5528 | −2.1554 | 16.1940 |
| 2.6667 | −2.2604 | 16.1940 |
| 2.7692 | −2.3536 | 16.1940 |
| 2.8604 | −2.4351 | 16.1940 |
| 2.9397 | −2.5054 | 16.1940 |
| 3.0069 | −2.5647 | 16.1940 |
| 3.0644 | −2.6153 | 16.1940 |
| 3.1129 | −2.6576 | 16.1940 |
| 3.1529 | −2.6924 | 16.1940 |
| 3.1849 | −2.7202 | 16.1940 |
| 3.2095 | −2.7416 | 16.1940 |
| 3.2280 | −2.7576 | 16.1940 |
| 3.2434 | −2.7709 | 16.1940 |
| 3.2533 | −2.7834 | 16.1940 |
| 3.2513 | −2.7952 | 16.1940 |
| 3.2411 | −2.8017 | 16.1940 |
| 3.2258 | −2.7967 | 16.1940 |
| 3.2078 | −2.7870 | 16.1940 |
| 3.1862 | −2.7753 | 16.1940 |
| 3.1575 | −2.7596 | 16.1940 |
| 3.1202 | −2.7391 | 16.1940 |
| 3.0738 | −2.7133 | 16.1940 |
| 3.0175 | −2.6815 | 16.1940 |
| 2.9509 | −2.6430 | 16.1940 |
| 2.8737 | −2.5967 | 16.1940 |
| 2.7831 | −2.5410 | 16.1940 |
| 2.6796 | −2.4753 | 16.1940 |
| 2.5636 | −2.3990 | 16.1940 |
| 2.4358 | −2.3112 | 16.1940 |
| 2.2965 | −2.2114 | 16.1940 |
| 2.1462 | −2.0988 | 16.1940 |
| 1.9916 | −1.9783 | 16.1940 |
| 1.8323 | −1.8505 | 16.1940 |
| 1.6681 | −1.7155 | 16.1940 |
| 1.4991 | −1.5737 | 16.1940 |
| 1.3248 | −1.4256 | 16.1940 |
| 1.1447 | −1.2717 | 16.1940 |
| 0.9589 | −1.1119 | 16.1940 |

TABLE A-continued

| X | Y | Z |
|---|---|---|
| 0.7734 | −0.9517 | 16.1940 |
| 0.5882 | −0.7912 | 16.1940 |
| 0.4035 | −0.6302 | 16.1940 |
| 0.2191 | −0.4687 | 16.1940 |
| 0.0350 | −0.3070 | 16.1940 |
| −0.1487 | −0.1448 | 16.1940 |
| −0.3319 | 0.0179 | 16.1940 |
| −0.5147 | 0.1811 | 16.1940 |
| −0.6971 | 0.3448 | 16.1940 |
| −0.8790 | 0.5090 | 16.1940 |
| −1.0606 | 0.6735 | 16.1940 |
| −1.2359 | 0.8329 | 16.1940 |
| −1.4049 | 0.9871 | 16.1940 |
| −1.5676 | 1.1360 | 16.1940 |
| −1.7241 | 1.2797 | 16.1940 |
| −1.8741 | 1.4183 | 16.1940 |
| −2.0176 | 1.5519 | 16.1940 |
| −2.1548 | 1.6803 | 16.1940 |
| −2.2855 | 1.8038 | 16.1940 |
| −2.4034 | 1.9170 | 16.1940 |
| −2.5090 | 2.0194 | 16.1940 |
| −2.6022 | 2.1111 | 16.1940 |
| −2.6887 | 2.1979 | 16.1940 |
| −2.7630 | 2.2738 | 16.1940 |
| −2.8197 | 2.3326 | 16.1940 |
| −2.8648 | 2.3800 | 16.1940 |
| −2.8984 | 2.4157 | 16.1940 |
| −2.9219 | 2.4439 | 16.1940 |
| −2.9322 | 2.4615 | 16.1940 |
| −2.9360 | 2.4740 | 16.1940 |
| −2.9359 | 2.4805 | 16.1940 |
| −2.9347 | 2.4835 | 16.1940 |
| −2.9250 | 2.5693 | 16.8140 |
| −2.9236 | 2.5703 | 16.8140 |
| −2.9203 | 2.5711 | 16.8140 |
| −2.9138 | 2.5699 | 16.8140 |
| −2.9019 | 2.5640 | 16.8140 |
| −2.8856 | 2.5515 | 16.8140 |
| −2.8577 | 2.5269 | 16.8140 |
| −2.8204 | 2.4943 | 16.8140 |
| −2.7702 | 2.4513 | 16.8140 |
| −2.7071 | 2.3981 | 16.8140 |
| −2.6243 | 2.3298 | 16.8140 |
| −2.5280 | 2.2521 | 16.8140 |
| −2.4244 | 2.1702 | 16.8140 |
| −2.3071 | 2.0790 | 16.8140 |
| −2.1759 | 1.9787 | 16.8140 |
| −2.0307 | 1.8696 | 16.8140 |
| −1.8788 | 1.7557 | 16.8140 |
| −1.7204 | 1.6366 | 16.8140 |
| −1.5558 | 1.5121 | 16.8140 |
| −1.3852 | 1.3819 | 16.8140 |
| −1.2090 | 1.2454 | 16.8140 |
| −1.0274 | 1.1024 | 16.8140 |
| −0.8409 | 0.9525 | 16.8140 |
| −0.6493 | 0.7956 | 16.8140 |
| −0.4591 | 0.6370 | 16.8140 |
| −0.2703 | 0.4767 | 16.8140 |
| −0.0829 | 0.3149 | 16.8140 |
| 0.1031 | 0.1514 | 16.8140 |
| 0.2875 | −0.0137 | 16.8140 |
| 0.4705 | −0.1805 | 16.8140 |
| 0.6522 | −0.3487 | 16.8140 |
| 0.8326 | −0.5182 | 16.8140 |
| 1.0118 | −0.6892 | 16.8140 |
| 1.1900 | −0.8611 | 16.8140 |
| 1.3676 | −1.0338 | 16.8140 |
| 1.5386 | −1.2013 | 16.8140 |
| 1.7035 | −1.3633 | 16.8140 |
| 1.8621 | −1.5199 | 16.8140 |
| 2.0143 | −1.6712 | 16.8140 |
| 2.1605 | −1.8168 | 16.8140 |
| 2.3012 | −1.9563 | 16.8140 |
| 2.4366 | −2.0894 | 16.8140 |
| 2.5610 | −2.2101 | 16.8140 |
| 2.6742 | −2.3187 | 16.8140 |
| 2.7760 | −2.4152 | 16.8140 |
| 2.8666 | −2.4997 | 16.8140 |

TABLE A-continued

| X | Y | Z |
|---|---|---|
| 2.9454 | −2.5725 | 16.8140 |
| 3.0122 | −2.6340 | 16.8140 |
| 3.0694 | −2.6865 | 16.8140 |
| 3.1176 | −2.7304 | 16.8140 |
| 3.1573 | −2.7665 | 16.8140 |
| 3.1891 | −2.7953 | 16.8140 |
| 3.2135 | −2.8175 | 16.8140 |
| 3.2319 | −2.8341 | 16.8140 |
| 3.2472 | −2.8480 | 16.8140 |
| 3.2570 | −2.8609 | 16.8140 |
| 3.2548 | −2.8728 | 16.8140 |
| 3.2444 | −2.8793 | 16.8140 |
| 3.2290 | −2.8741 | 16.8140 |
| 3.2110 | −2.8639 | 16.8140 |
| 3.1893 | −2.8517 | 16.8140 |
| 3.1605 | −2.8353 | 16.8140 |
| 3.1231 | −2.8140 | 16.8140 |
| 3.0763 | −2.7873 | 16.8140 |
| 3.0197 | −2.7544 | 16.8140 |
| 2.9527 | −2.7147 | 16.8140 |
| 2.8749 | −2.6673 | 16.8140 |
| 2.7835 | −2.6104 | 16.8140 |
| 2.6789 | −2.5433 | 16.8140 |
| 2.5619 | −2.4655 | 16.8140 |
| 2.4330 | −2.3759 | 16.8140 |
| 2.2926 | −2.2739 | 16.8140 |
| 2.1415 | −2.1587 | 16.8140 |
| 1.9863 | −2.0352 | 16.8140 |
| 1.8265 | −1.9039 | 16.8140 |
| 1.6619 | −1.7652 | 16.8140 |
| 1.4926 | −1.6194 | 16.8140 |
| 1.3179 | −1.4671 | 16.8140 |
| 1.1374 | −1.3090 | 16.8140 |
| 0.9511 | −1.1448 | 16.8140 |
| 0.7652 | −0.9803 | 16.8140 |
| 0.5796 | −0.8154 | 16.8140 |
| 0.3946 | −0.6497 | 16.8140 |
| 0.2101 | −0.4836 | 16.8140 |
| 0.0260 | −0.3171 | 16.8140 |
| −0.1576 | −0.1499 | 16.8140 |
| −0.3406 | 0.0178 | 16.8140 |
| −0.5231 | 0.1862 | 16.8140 |
| −0.7049 | 0.3553 | 16.8140 |
| −0.8862 | 0.5250 | 16.8140 |
| −1.0669 | 0.6952 | 16.8140 |
| −1.2411 | 0.8603 | 16.8140 |
| −1.4092 | 1.0199 | 16.8140 |
| −1.5711 | 1.1738 | 16.8140 |
| −1.7268 | 1.3223 | 16.8140 |
| −1.8761 | 1.4656 | 16.8140 |
| −2.0188 | 1.6038 | 16.8140 |
| −2.1552 | 1.7365 | 16.8140 |
| −2.2850 | 1.8643 | 16.8140 |
| −2.4018 | 1.9815 | 16.8140 |
| −2.5062 | 2.0878 | 16.8140 |
| −2.5983 | 2.1829 | 16.8140 |
| −2.6838 | 2.2730 | 16.8140 |
| −2.7572 | 2.3517 | 16.8140 |
| −2.8132 | 2.4125 | 16.8140 |
| −2.8578 | 2.4615 | 16.8140 |
| −2.8910 | 2.4984 | 16.8140 |
| −2.9141 | 2.5276 | 16.8140 |
| −2.9241 | 2.5457 | 16.8140 |
| −2.9276 | 2.5584 | 16.8140 |
| −2.9273 | 2.5650 | 16.8140 |
| −2.9260 | 2.5680 | 16.8140 |

It should be appreciated that the nominal airfoil profile disclosed in TABLE A may be scaled up or down geometrically for use in other similar airfoil designs. Consequently, the X, Y and Z coordinates of the nominal airfoil profile may be a function of a constant. That is, the X, Y and Z coordinate values may be multiplied or divided by the same constant or number to provide a "scaled-up" or "scaled-down" version of the airfoil profile, while retaining the airfoil section shape disclosed herein.

It should also be appreciated that the airfoil profile defined by the coordinate values of TABLE A can generally be applied in any suitable gas turbine compressor known in the art including, but not limited to, various compressors provided by General Electric, such as "7F" compressors, "7FA" compressors, "7FA+" compressors, and "7FA+e" compressors. Additionally, it should be appreciated that the airfoil profile defined by the coordinates of TABLE A may also be applied in any other suitable machine using and/or component having an airfoil shape.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An article of manufacture, the article having a nominal profile generally in accordance with Cartesian coordinate values of X, Y and Z set forth in TABLE A, and wherein X and Y are distances in inches which, when connected by smooth continuing arcs, define airfoil profile sections at each distance Z in inches, the airfoil profile sections at the Z distances being joined smoothly with one another to form a complete airfoil shape.

2. The article of claim 1, wherein the article comprises an airfoil.

3. The article of claim 1, wherein the nominal profile lies in an envelope within +/−0.160 inches in a direction normal to any article surface location.

4. The article of claim 1, wherein the article comprises a rotor blade.

5. The article of claim 4, wherein the rotor blade comprises a Stage Zero rotor blade of a compressor.

6. The article of claim 1, wherein the article comprises a stator vane.

7. A rotor blade including an airfoil, the airfoil having a nominal profile generally in accordance with Cartesian coordinate values of X, Y and Z set forth in TABLE A, and wherein X and Y are distances in inches which, when connected by smooth continuing arcs, define airfoil profile sections at each distance Z in inches, the airfoil profile sections at the Z distances being joined smoothly with one another to form a complete airfoil shape.

8. The rotor blade of claim 7, wherein the rotor blade forms comprises a Stage Zero rotor blade of a compressor.

9. The rotor blade of claim 7, wherein the nominal profile lies in an envelope within +/−0.160 inches in a direction normal to any airfoil surface location.

10. A compressor comprising:

a rotor wheel; and a plurality of rotor blades mounted to the rotor wheel, each of the plurality of rotor blades including an airfoil, the airfoil having a nominal profile generally in accordance with Cartesian coordinate values of X, Y and Z set forth in TABLE A, and wherein X and Y are distances in inches which, when connected by smooth continuing arcs, define airfoil profile sections at each distance Z in inches, the airfoil profile sections at the Z distances being joined smoothly with one another to form a complete airfoil shape.

11. The compressor of claim 10, wherein the nominal profile lies in an envelope within +/−0.160 inches in a direction normal to any airfoil surface location.

12. The compressor of claim 10, wherein the plurality of rotor blades forms part of a Stage Zero of the compressor.

* * * * *